US009388532B2

(12) United States Patent
Koyama et al.

(10) Patent No.: US 9,388,532 B2
(45) Date of Patent: Jul. 12, 2016

(54) WATER-DISPERSIBLE PAPER

(71) Applicant: NIPPON PAPER PAPYLIA CO., LTD., Fuji-shi, Shizuoka (JP)

(72) Inventors: Munenaka Koyama, Fuji (JP); Masaki Kishimoto, Fuji (JP); Yoshiaki Ishino, Fuji (JP)

(73) Assignee: NIPPON PAPER PAPYLIA CO., LTD., Fuji-Shi (JP)

( * ) Notice: Subject to any disclaimer, the term of this patent is extended or adjusted under 35 U.S.C. 154(b) by 0 days.

(21) Appl. No.: 14/451,016

(22) Filed: Aug. 4, 2014

(65) Prior Publication Data

US 2014/0338851 A1 Nov. 20, 2014

Related U.S. Application Data

(63) Continuation of application No. 13/812,824, filed as application No. PCT/JP2011/067237 on Jul. 28, 2011, now Pat. No. 8,877,678.

(30) Foreign Application Priority Data

Jul. 28, 2010 (JP) ..... 2010-169561

(51) Int. Cl.

| | |
|---|---|
| ***B41M 5/41*** | (2006.01) |
| ***B41M 5/50*** | (2006.01) |
| ***D21H 13/02*** | (2006.01) |
| ***D21H 11/20*** | (2006.01) |
| ***D21H 11/00*** | (2006.01) |
| ***G09F 3/00*** | (2006.01) |
| ***D21H 19/12*** | (2006.01) |
| *D21H 19/36* | (2006.01) |

(52) U.S. Cl.

CPC ..... *D21H 13/02* (2013.01); *B41M 5/41* (2013.01); *B41M 5/508* (2013.01); *D21H 11/00* (2013.01); *D21H 11/20* (2013.01); *D21H 19/12* (2013.01); *G09F 3/0291* (2013.01); *D21H 19/36* (2013.01); *Y10T 428/24802* (2015.01); *Y10T 428/24934* (2015.01); *Y10T 428/2848* (2015.01); *Y10T 428/31993* (2015.04)

(58) Field of Classification Search

CPC ..... B41M 5/41; B41M 5/508; B41M 5/50; Y10T 428/24934; Y10T 428/31993

USPC ..... 428/32.21, 211.1, 537.5; 503/200

See application file for complete search history.

(56) References Cited

U.S. PATENT DOCUMENTS

| | | | |
|---|---|---|---|
| 2006/0216537 | A1 | 9/2006 | Natsui et al. |
| 2008/0071078 | A1 | 3/2008 | Kizer et al. |

FOREIGN PATENT DOCUMENTS

| | | | |
|---|---|---|---|
| GB | 1125956 | A | 9/1968 |
| JP | S43-001214 | B | 1/1968 |
| JP | H03-008897 | A | 1/1991 |
| JP | H06-184984 | A | 7/1994 |
| JP | H10-310960 | A | 11/1998 |
| JP | 2000-170100 | A | 6/2000 |
| JP | 2004-314623 | A | 11/2004 |
| JP | 2006-299498 | A | 11/2006 |
| JP | 2009-052152 | A | 3/2009 |
| JP | 2010-504376 | A | 2/2010 |

OTHER PUBLICATIONS

International Search Report (ISR) mailed Nov. 1, 2011, issued for corresponding International application No. PCT/JP2011/067237.

Notification of Transmittal of Translation of the International Preliminary Report on Patentability (PCT/IB/338) mailed Feb. 14, 2013, with International Preliminary Report on Patentability (PCT/IB/373) and Written Opinion of the International Searching Authority (PCT/ISA/237), for corresponding international application PCT/JP2011/067237.

Non-final Office action issued by the USPTO, dated May 5, 2014, for U.S. Appl. No. 13/812,824.

*Primary Examiner* — Bruce H Hess

(74) *Attorney, Agent, or Firm* — Law Office of Katsuhiro Arai

(57) ABSTRACT

A water dispersion paper made of wood pulp and/or non-wood pulp is characterized in that purified pulp containing α-cellulose by 88 percent by weight or more accounts for 15 to 95 percent by weight of all pulp. The water dispersion paper has quick water dispersion property and high strength (printability) and its paper surface pH is 6 to 8 (neutral range).

14 Claims, No Drawings

WATER-DISPERSIBLE PAPER

CROSS-REFERENCE TO RELATED APPLICATIONS

This application is a continuation of U.S. patent application Ser. No. 13/812,824, filed Apr. 8, 2013 (§371(c)(1), (2), (4) Date), which is the U.S. National Phase under 35 U.S.C. §371 of International Application PCT/JP2011/067237, filed Jul. 28, 2011, which claims priority to Japanese Patent Application No. 2010-169561, filed Jul. 28, 2010, each disclosure of which is herein incorporated by reference in its entirety. The International Application was published under PCT Article 21(2) in the language other than English.

The applicant herein explicitly rescinds and retracts any prior disclaimers or disavowals made in any parent, child or related prosecution history with regard to any subject matter supported by the present application.

BACKGROUND OF THE INVENTION

1. Field of the Invention

The present invention refers to a paper that disperses quickly in water. This type of paper is called "water dispersion paper" or "water-dispersible paper."

Water dispersion papers are sometimes used for confidential documents because they can be dispersed in water for disposal. Products that take advantage of the water absorbability and property to disperse/disintegrate in water of these papers include flushable toilet papers and toilet cleaning papers. For their water absorbability, water dispersion papers are also utilized for semination sheets and other agricultural materials, as well as sanitary materials and medical materials.

2. Description of the Related Art

Water dispersion papers proposed so far include one made by mixing papermaking fibers and fiber carboxymethyl cellulose and then adding an alkali metal compound (Patent Literature 1), and one made by mixing a water-insoluble or low-water-soluble inorganic powder into papermaking fibers or carboxymethyl cellulose (Patent Literature 2). In addition to the above, a water dispersion paper made by coating a water-soluble binder onto a support made by mixing papermaking fibers and regenerated cellulose fibers (Patent Literature 3) is also proposed, among others. Other water dispersion papers being proposed include one made by blending an alkali metal salt or alkali earth metal salt of carboxymethyl cellulose into papermaking fibers (Patent Literature 4) and one made by coating a water-soluble polymer onto a base paper made by blending hydrophobic low-molecular compound into papermaking water-dispersible fibers (Patent Literature 5), and the like.

Reflecting a growing interest in environmental issues of late, returnable containers are drawing the attention. Returnable containers generally bear an adhesive label made of a press-printed or printer-printed coated paper having an adhesive layer provided on the back side. However, separating this label from the container after use requires a cumbersome cleaning process.

To ease such trouble of cleaning, an adhesive sheet that disintegrates in water is disclosed, which is made of a water-soluble or water-dispersible base material having a coating layer appropriate for each of various recording methods provided on top (Patent Literature 6). A coated paper that separates in water is also disclosed, which is made of a base material containing water-insoluble fiber carboxy alkyl cellulose and alkalization agent, with a coating layer provided on top (Patent Literature 7).

RELATED ART REFERENCES

Patent Literature 1: Examined Japanese Patent Laid-open No. Sho 43-001214

Patent Literature 2: Japanese Patent Laid-open No. Hei 03-008897

Patent Literature 3: Japanese Patent Laid-open No. 2009-052152

Patent Literature 4: Japanese Patent Laid-open No. Hei 06-184984

Patent Literature 5: Japanese Patent Laid-open No. 2000-170100

Patent Literature 6: Japanese Patent Laid-open No. 2004-314623

Patent Literature 7: Japanese Patent Laid-open No. 2006-299498

Patent Literature 8: Published Japanese Translation of PCT International Patent Application No. 2010-504376

SUMMARY OF THE INVENTION

However, a water dispersion paper made by mixing papermaking fibers and fiber carboxymethyl cellulose and then adding an alkali metal compound, or one made by mixing a water-insoluble or low-water-soluble inorganic powder into papermaking fibers or carboxymethyl cellulose, is alkaline and the water in which the paper is dispersed also exhibits alkalinity. Accordingly, use of such paper may be limited in applications involving plant or animal, medical applications, applications where the paper comes in contact with food, etc., or film lamination applications.

For example, when the germination ratio and growth rate of germination roots of radish six days after the sawing date were studied using a semination sheet using a water dispersion paper made by mixing papermaking fibers and fiber carboxymethyl cellulose and then adding an alkali metal compound (water-soluble paper 60MDP by Nippon Paper Papylia with a paper surface pH of 8.8) and another using a non-water-dispersible filter paper with a paper surface pH of 7.0 (made by Toyo Roshi), the germination ratio was 97% with the filter paper and 85% with 60MDP, while the root length and stem length were 41.0 mm and 46.2 mm with the filter paper, respectively, and 15.9 mm and 39.9 mm with 60MDP, respectively. If a water dispersion paper is laminated with a water-soluble resin film, the ester group contained in the water-soluble resin film or water-soluble adhesive used to laminate the water-soluble resin film and water dispersion paper will react with the alkaline water dispersion paper and may cause the water solubility of the water-soluble resin film to drop or cause adhesive failure.

A water dispersion paper made by adding an aqueous solution of water-soluble binder to a sheet obtained by mixing papermaking fibers and rayon or other regenerated cellulose fibers presents such problems as difficulty achieving sufficient strength and the quality of the water dispersion paper not becoming uniform, because the regenerated cellulose does not easily bond strongly with the papermaking fibers via the water-soluble binder. This water dispersion paper also presents problems in screen printing, gravure printing, flexo-printing, sublimation printing, thermal transfer printing, etc., as the regenerated cellulose fibers produce lint or detach to generate paper powder, resulting in unfavorable printability.

A water dispersion paper made by blending an alkali metal salt or alkali earth metal salt of carboxymethyl cellulose into papermaking fibers provides a neutral paper, but it is difficult to provide a water dispersion paper which needs to have quick water dispersion property because, as carboxymethyl cellulose is added to water in the form of water-soluble salt during the course of papermaking, a film of carboxymethyl cellulose salt is formed after drying and the rate of water dispersion slows. Also, a water dispersion paper made by coating a water-soluble polymer onto a base paper made by blending hydrophobic low-molecular compound into papermaking water-dispersible fibers is such that, because water dispersion property is enhanced by the inter-fiber bonding-strength reducing effect of the hydrophobic low-molecular compound, increasing the additive amount of the hydrophobic low-molecular compound with the intention of achieving quick water dispersion property causes the hydrophilicity of base paper surface and strength of base paper to drop by an extreme degree and these lowered hydrophilicity and strength of base paper cannot easily be recovered by coating the water-soluble polymer. Thus it is difficult to provide a water dispersion paper which needs to have quick water dispersion property.

Furthermore, the thermo-sensitive recording sheet that disintegrates in water, as described in Patent Literature 6, can be used for a label that easily separates from the returnable container, because the sheet consists of a base material made of water-soluble paper or water dispersion paper, with a sealer layer constituted by non-water-soluble resin and a coating layer (thermo-sensitive recording layer) provided on top, but this application present problems, one of which is that the sealer layer of non-water-soluble resin separates like a film and clogs the wastewater pipe. The coated paper that separates in water as described in Patent Literature 7 expresses good separation performance in water as the non-water-soluble carboxy alkyl cellulose fibers contained in the base material turn into a metal salt of water-soluble carboxy alkyl cellulose fibers due to the alkalization agent. However, it is difficult to add just the right amount of alkalization agent needed to neutralize the carboxy alkyl cellulose, which makes it necessary to add an excessive amount of alkalization agent to achieve complete neutralization. As a result, the coated paper that separates in water according to Patent Literature 7 changes color over time due to excessive alkalization agent.

In light of the above, an object of the present invention is to provide a water dispersion paper having quick water dispersion property and high strength (printability) as well as paper surface pH of 6 to 8 (neutral range), and also to achieve a water dispersion coated paper ensuring quick water dispersion property and prevention of discoloration over time.

The present invention was completed following the discovery that a water dispersion paper made of wood pulp and/or non-wood pulp, where 15 to 95 percent by weight of the pulp represents purified pulp containing α-cellulose by 88 percent by weight or more, would exhibit quick water dispersion property even when the paper surface pH is adjusted to a range of 6 to 8. The present invention was also completed following the discovery that a water-dispersible coated paper constituted by a base material made of wood pulp and/or non-wood pulp and at least one water-based coating layer provided on top, where 15 to 95 percent by weight of the pulp constituting the base material represents purified pulp containing α-cellulose by 88 percent by weight or more and no alkalization agent is needed as a result, would ensure quick water dispersion property and prevention of discoloration over time.

The primary constitutions of the present invention are as follows:

[1] A water dispersion paper made of wood pulp and/or non-wood pulp, wherein said paper is characterized in that purified pulp containing α-cellulose by 88 percent by weight or more accounts for 15 to 95 percent by weight of all pulp.

[2] A water dispersion paper made of wood pulp and/or non-wood pulp, wherein said paper is characterized in that purified pulp containing hemi-cellulose by less than 12 percent by weight accounts for 15 to 95 percent by weight of all pulp.

[3] A water dispersion paper according to [1] or [2], characterized in that it does not contain regenerated cellulose fiber, fiber carboxymethyl cellulose or fiber carboxymethyl cellulose Na salt.

[4] A water dispersion paper according to [1] or [2], characterized in that its paper surface pH is 6 to 8.

[5] A water dispersion paper according to [1] or [2], characterized in that its floc water dispersion time, measured by putting a test piece of 3×3 cm square in water in a beaker and then agitating the water with a stirrer at 650 rpm until the test piece tears into two or more pieces, is within 30 seconds.

[6] A water dispersion coated paper, consisting of a base material being a water dispersion paper according to [1] or [2], with a coating layer primarily constituted by water-based coating material provided on top.

[7] A water dispersion coated paper according to [6], characterized in that its coating layer is a thermo-sensitive recording layer, inkjet recording layer or general printing layer.

[8] A water dispersion coated paper according to [6], characterized in that a water-soluble sealer layer is provided between the base material and coating layer and/or on the uncoated side of the base material.

[9] A water dispersion coated paper according to [6], characterized in that a water-soluble or water-redispersible pressure-sensitive adhesive is used to provide a pressure-sensitive adhesive layer on another side of the base material opposite to one side on which the coating layer is formed.

[10] A water dispersion coated paper according to [6], characterized in that it is a printing paper for confidential document.

[11] A water dispersion coated paper according to [9], characterized in that it is a label displaying information of food material, etc., on the coating layer.

Effects of the Invention

The present invention realizes a paper offering excellent water dispersion property by using specific purified pulp containing α-cellulose by 88 percent by weight or more to account for 15 to 95 percent by weight of all pulp. According to the present invention, a water dispersion paper with a paper surface pH of 6 to 8, having quick water dispersion property and high strength (printability), can be obtained. Also according to the present invention, a coated paper that disperses water, ensuring quick water dispersion property and prevention of discoloration over time, can be obtained.

A water dispersion paper according to the present invention consists of two or more types of wood pulp and/or non-wood pulp of different degrees of refining blended together, where regenerated cellulose fibers and other fibers whose inter-fiber bonding is excessively weak are not used, and therefore the paper offers high tensile strength and surface strength while having quick water dispersion property, produces less paper breakage and lint when used in offset printing and other printing applications, and exhibits excellent printability.

A water dispersion paper according to the present invention does not use fiber carboxymethyl cellulose, which eliminates the need for alkalization agent to neutralize the carboxyl group and therefore prevents excessive alkalization agent from remaining in the paper and causing the paper to exhibit alkalinity. As a result, the paper does not yellow (change to yellow) over time and its storage stability improves. Furthermore, various coated papers made by coating a thermo-sensitive recording layer, inkjet recording layer or general printing layer on the water dispersion paper being the base material, and processed papers made by laminating the water dispersion paper with a water-soluble resin film, can be processed just like any general neutral paper, without causing the quality of the coating layer or water-soluble resin film to drop, because the base material is neutral.

A water dispersion paper according to the present invention has a water-soluble sealer layer between the base material and coating layer and/or on the uncoated side of the base material, and this prevents excessive permeation of coating solution into the base material when the coating layer is formed, thereby allowing for formation of uniform coating layer. If a pressure-sensitive adhesive layer is provided on the uncoated side of the base material, the sealer layer prevents migration of the pressure-sensitive adhesive agent into the paper or coating layer, which in turn prevents drop in pressure-sensitive adhesive force over time or desensitization of the thermo-sensitive recording layer due to the pressure-sensitive adhesive component.

A water dispersion paper and water dispersion coated paper according to the present invention are suitable for use-by date labels on food trays, marking sheets for returnable containers and other media that attach variable information to a container and are washed away when the container is cleaned after use, as well as for printing papers for confidential information that can be dispersed in water for disposal.

DETAILED DESCRIPTION OF EMBODIMENTS

The present invention is a water-dispersible paper made primarily of pulp and offering excellent dispersion property in water. The present invention is a paper offering excellent water dispersion property, made by blending purified pulp containing α-cellulose by 88 percent by weight or more to account for 15 to 95 percent by weight of all pulp, and pulp other than purified pulp accounting for the rest. The present invention also provides a water-dispersible coated paper consisting of this water-dispersible paper as the base material, and a coating layer provided on it, to exhibit improved printing characteristics as well as water dispersion property.

The water-dispersible paper provided by the present invention exhibits dispersion property in water, whereby it disperses finely within 30 seconds and disintegrate into fibers within 80 seconds. The water-dispersible paper proposed by the present invention has high paper strength and printability, so it permits clean printing on a coating layer formed on it. Since the paper is neutral, it has high resistance to yellowing and other discoloration.

Under the present invention, it is important to blend purified pulp and unpurified pulp, and use of either one of them alone cannot ensure sufficient quality. It is also inappropriate to use cellulose fibers of high α-cellulose content that have been purified through a process of obtaining regenerated cellulose (such as short rayon fibers), because it causes the paper strength to drop and presents other problems. Under the present invention, a preferred mode is to use pulp fibers maintaining a natural pulp fiber form.

A water-dispersible paper according to the present invention, and coated paper using said water-dispersible paper, are suitable for applications where the paper is put in water to be disintegrated into fine pieces. For example, they can be used as use-by date labels on food trays used at restaurants, etc., recycled container labels, returnable container marking sheets, and so on, where the label/sheet is put in water together with the container or tray and as the water is agitated and container/tray cleaned, the water dispersion paper separates and disintegrates into small pieces and is discharged with wastewater. If the paper is used for semination sheets or labels for food packing materials, alkalinity does not present harmful effects. Semination sheets can be implemented directly in crop fields and nursery fields and improve the efficiency of semination process and germination ratio due to their water absorbability and disintegration property. If the paper is used for food packing material labels, there is no concern that alkaline content will remain on the label-attached tray after cleaning and the efficiency of cleaning process improves.

Other applications of a water-dispersible paper according to the present invention and a coated paper using said water-dispersible paper, include printing papers for confidential information. For example, ATM transaction statements at banks and other financial institutions, insurance drug dispensing statements and other documents bearing personal information, and confidential paper documents used by companies, are often shredded. In the U.S. and other countries, however, many crimes are reported where these shreds are reconstituted and the restored confidential information is used for ill purposes. A water-dispersible paper according to the present invention and a coated paper using said water-dispersible paper can be easily printed with confidential information using a thermo-sensitive printer, inkjet printer, printing, etc., but once the paper is dispersed in water after use, the confidential information can be eliminated completely with ease.

<Purified Pulp>

Purified pulp used by the present invention is, for example, mercerized pulp or dissolving pulp made of wood from needle-leaved trees, broad-leaved trees, etc., or non-wood such as hemp and linter, where the cooking conditions for manufacturing of pulp are reinforced and hemi-cellulose, etc., are removed by a chemical process before or after cooking to increase the purity of cellulose, or specifically pulp that has been purified to an α-cellulose content of 88 percent by weight or more.

As for the relationship between the α-cellulose content and hemi-cellulose content of pulp, Published Japanese Translation of PCT International Patent Application No. 2010-504376 (Patent Literature 8) classifies various types of pulp into three grades according to the degree of refining, or namely "acetate grade" representing highly purified pulp, "viscose grade" representing purified pulp, and "paper/fluff grade" representing unpurified pulp, and indicates the contents for each grade. "Acetate grade" pulp normally contains α-cellulose by 95 percent by weight or more and hemi-cellulose by approx. 1 to 3 percent, while "viscose grade" pulp contains α-cellulose by 88 to 95 percent by weight and hemi-cellulose by approx. 5 to 12 percent. "Paper/fluff grade" pulp contains α-cellulose by 80 to 88 percent by weight and hemi-cellulose by approx. 12 to 20 percent.

Based on the above, hemi-cellulose contained in purified pulp used by the present invention is less than 12 percent by weight.

It should be noted that, under the present invention, pulp is defined as "Aggregate of cellulose fibers extracted from wood or other plant by a mechanical or chemical process" (Kami Parupu Jiten (Dictionary of Pulp and Paper), Feb. 20, 2000, Japan TAPPI, Kanehara & Co., Ltd.), which is considered a general definition of pulp.

Purified pulp under the present application for patent excludes rayon and other regenerated cellulose fibers, fiber carboxymethyl cellulose and fiber carboxymethyl cellulose Na salt.

Mercerized pulp refers to pulp obtained by soaking kraft pulp or sulfite pulp in strong alkali solution and then washing the pulp in water to remove the alkali component.

Dissolving pulp refers to pulp of high cellulose purity obtained by means of sulfite cooking or prehydrolysis kraft cooking, where pulp of varying cellulose purity can be obtained by combining a post-cooking bleaching and selection process.

The reason why excellent dispersion property can be obtained under the present invention is presumed as follows. Purified pulp has a very low hemi-cellulose content that contributes to swelling of fibers and agglutination among fibers, so in an unbeaten form, this pulp forms a weak, bulky sheet offering high water dispersion property. Once purified pulp is beaten, its low hemi-cellulose content suppresses swelling and fibrillation of fibers due to beating, which in turn prevents the water retention level from increasing much, makes the fiber rigid and straight and easy to break, and thereby increases short fibers. As a result, a sheet formed from beaten purified pulp effectively retains its original water dispersion property because, although its strength increases and bulkiness decreases somewhat as compared to the unbeaten state, short fibers that contribute to improvement of water dispersion property increase.

Under the present invention, α-cellulose content is used as an indicator for cellulose purity of purified pulp. The α-cellulose content of purified pulp must be 88 percent by weight or more, or preferably 92 percent by weight or more, or more preferably 95 percent by weight or more. If purified pulp contains α-cellulose by less than 88 percent by weight, it becomes difficult for the pulp to disperse as single fibers and therefore its dispersion property in water drops. Note that, under the present invention, α-cellulose content is measured based on the α-cellulose specified in the TAPPI Standard T203om-83 (JIS P 8101-1994 (already obsolete)).

Under the present invention, hemi-cellulose content is used as another indicator of cellulose purity of purified pulp. The hemi-cellulose content of purified pulp must be less than 12 percent by weight, or preferably less than 8 percent by weight, or more preferably less than 5 percent by weight. If purified pulp contains hemi-cellulose by 12 percent by weight or more, it becomes difficult for the pulp to disperse as single fibers and therefore its dispersion property in water drops. Note that, under the present invention, hemi-cellulose content is measured by acid-hydrolyzing purified pulp or unpurified pulp into monosaccharides and then quantifying the compositions of monosaccharides by the alditol acetate method. Specifically, the monosaccharides obtained by hydrolysis of pulp are reduced by sodium borohydride into equivalent alditol acetate, which is then acetylated with acetic anhydride and pyridine into an alditol acetate derivative, after which this alditol acetate derivative is analyzed by gas chromatography to identify and quantify the component saccharides.

Note that α-cellulose content and hemi-cellulose content can also be measured for a paper made by blending purified pulp and unpurified pulp, as with a paper made only of each pulp. In addition, by observing the fiber form of pulp and obtaining the blending ratio of purified pulp and unpurified pulp, α-cellulose content and hemi-cellulose content can be calculated separately for the purified pulp portion and unpurified pulp portion.

Under the present invention, the water retention level of purified pulp whose α-cellulose content is 88 percent by weight or more (hereinafter also referred to simply as "purified pulp") is 140 percent by less, or preferably 120 percent by less, when the purified pulp is beaten to a freeness of 450 ml CSF based on the Canadian Standard Freeness (hereinafter referred to as "freeness"), from the viewpoint of water dispersion property.

Purified pulp having a water retention level in this range consists of fibers that are difficult to swell and fibrillate, so more of beating energy is used to break fibers. As a result, the beaten purified pulp has low inter-fiber bonding capacity and short fibers, resulting in a sheet offering high water dispersion property. On the other hand, purified pulp whose water retention level at a freeness of 450 ml CSF exceeds 140% undergoes swelling and fibrillation of fibers, when beaten, and inter-fiber bonding increases, which makes it difficult to obtain a sheet that disperses into single fibers. Note that water retention level is an indicator of swelling level of pulp as specified in JAPAN TAPPI No. 26, representing the ratio to the total weight of pulp of the water content that has been taken in and retained in swollen fibers.

Under the present invention, the average fiber length of purified pulp is 0.1 to 5 mm, or preferably 0.5 to 3 mm, or more preferably 0.8 to 2 mm.

The water dispersion paper proposed by the present invention was developed with a focus on using a blend of normal unpurified wood pulp and/or non-wood pulp (hereinafter also referred to simply as "pulp") and purified pulp containing α-cellulose by 88 percent by weight or more and thereby offering characteristics different from normal pulp, and the paper exhibits both excellent water dispersion property and high strength.

<Unpurified Pulp>

In the water dispersion paper proposed by the present invention, examples of wood pulp and/or non-wood pulp other than purified pulp containing α-cellulose by 88 percent by weight or more include, among others, wood pulp from needle-leaved trees, broad-leaved trees, etc., and non-wood pulp from hemp, linter, kenaf, bagasse, manila hemp, etc. The aforementioned examples of wood pulp and/or non-wood pulp other than purified pulp have a high hemi-cellulose content that contributes to formation of inter-fiber bonding, and as their fibers swell and fibrillate easily, they form a dense, strong paper with low water dispersion property. This trend becomes more prominent when pulp is beaten further, which suggests that a paper that offers good water dispersion property and is also strong cannot be obtained only from unpurified pulp.

Pulp of fiber carboxymethyl cellulose Na salt and regenerated cellulose fibers are not used. Pulp of fiber carboxymethyl cellulose Na salt, which is made by alkali-treating fiber carboxymethyl cellulose, is inappropriate because alkali may have negative effects depending on the application and the pulp changes color easily. Regenerated cellulose fibers are also inappropriate because poor sheet strength and smoothness result in poor printability.

<Pulp Blending and Papermaking>

The water dispersion paper proposed by the present invention must be such that purified pulp containing α-cellulose by 88 percent by weight or more accounts for 15 to 95 percent by weight, or preferably 20 to 80 percent by weight, or more preferably 20 to 60 percent by weight, of all pulp constituting the water dispersion paper. If the blending ratio of purified pulp is less than 15 percent by weight, inter-fiber bonding of fibers that form the sheet becomes too strong and sufficient water dispersion property cannot be obtained.

If the blending ratio of purified pulp exceeds 95 percent by weight, on the other hand, sheet strength decreases considerably and ease of handling in practical situations drops.

Under the present invention, purified pulp and pulp can be beaten separately and then blended (hereinafter referred as "separate beating"), or they can be blended first and then beaten (hereinafter referred to as "mixed beating"), but mixed beating is preferred as it improves water dispersion property. Although the specific reason why it is preferred is not clear, it is probably because mixed beating induces some kind of interaction between purified pulp and pulp and causes unexpected benefits to manifest.

Under the present invention, the beating level of paper material made of a blend of purified pulp and pulp is 450 to 700 ml CSF in freeness, or preferably 550 to 650 ml CSF, based on freeness, regardless of whether separate beating or mixed beating is used. If the freeness is less than 450 ml CSF, inter-fiber bonding becomes stronger and favorable water dispersion property drops. If the freeness is 700 ml CSF or more, on the other hand, inter-fiber bonding weakens and sheet strength drops.

Under the present invention, it is preferable to use purified pulp whose water retention level at 450 ml CSF is 140 percent or less if purified pulp and pulp are put through mixed beating until the aforementioned freeness. When purified pulp whose water retention level at 450 ml CSF is 140 percent or less is used, beating energy is consumed for breaking the purified pulp, which produces short purified-pulp-derived fibers with minimal swelling and fibrillation and suppresses excessive beating of pulp, resulting in manifestation of excellent water dispersion property.

On the other hand, purified pulp whose water retention level at a freeness of 450 ml CSF exceeds 140 percent provides significantly lower water dispersion property because separate or mixed beating promotes swelling and fibrillation of fibers and increases inter-fiber bonding, as is the case of pulp. If such purified pulp is used without beating, drawbacks such as easy detachment of pulp fibers from the sheet and increase of paper powder will result.

The water dispersion paper proposed by the present invention can be manufactured from a paper material constituted by purified pulp and pulp using any known papermaking technology. Any paper machine can be used, such as cylinder (vat) paper machine, inclined tanmo paper machine, fourdrinier paper machine or twin-wire paper machine, and an appropriate machine can be selected according to the required strength and water dispersion property. If a cylinder paper machine is used, for example, a base paper that is weaker in lateral direction than longitudinal direction due to significant strength anisotropy and thus tears easily in water in lateral direction can be manufactured.

The base paper can be made as a single-layer sheet, or a paper machine having two or more wire cloths can be used to manufacture multiple wet papers from the same paper material and then the papers can be combined to manufacture a heavier sheet, or sheets made from different paper materials can be combined into a single paper.

<Paper Surface pH>

The paper surface pH of the water dispersion paper proposed by the present invention is adjusted to a range of 6 to 8 (neutral range), or preferably to a range of 6.2 to 7.2. By adjusting the paper surface pH to these ranges, the water dispersion paper can be used in applications involving plant or animal, medical applications, film lamination applications and other applications where use of such paper has not been possible.

Under the present invention, the method to adjust the paper surface pH is not limited in any way, and basically a water dispersion paper is manufactured by using a neutral material as the primary constituent. Or, a water dispersion paper can be manufactured by neutralizing an alkaline or acid water dispersion paper with an acid substance or alkaline substance. Note, however, that, if a water dispersion paper, which is made by mixing conventional papermaking fibers and fiber carboxymethyl cellulose and then adding an alkali metal compound, is neutralized with an acid substance, the fiber carboxymethyl cellulose becomes insoluble. Accordingly, a problem is that the water dispersion property drops significantly.

<Water Dispersion Property>

Under the present invention, water dispersion property can be evaluated by floc water dispersion time and fiber water dispersion time. The floc water dispersion time, defined as the time until a test piece of 3×3 cm square, put in a 300-ml beaker containing 300 ml of deionized water, tears into two or more pieces when agitated with a stirrer at 650 rpm, is within 30 seconds, or preferably within 20 seconds, or more preferably within 10 seconds. When this floc water dispersion time becomes longer, the drain or piping gets clogged by the flushed water dispersion paper.

On the other hand, the fiber dispersion time, defined as the time until a test piece of 3×3 cm square, put in a 300-ml beaker containing 300 ml of deionized water, completely disintegrates into single fibers when agitated with a stirrer at 650 rpm, is within 80 seconds, or preferably within 40 seconds, or more preferably within 20 seconds. When this fiber dispersion time becomes longer, the contaminant catch at the drain gets clogged by the flushed water dispersion paper.

<Additional Processing of Water Dispersion Paper>

The water dispersion paper proposed by the present invention can be calendered using a machine calender, super calender, soft nip calender or other general papermaking calender to improve smoothness for printing applications, etc.

It is also possible to laminate a water-soluble resin film to increase smoothness and air resistance. For the water-soluble resin film, water-soluble polyvinyl alcohol, polyalkylene oxide, polyalkylene oxide copolymer or other water-soluble resin is used in film form.

Preferably a water-soluble polymer is impregnated into or coated onto the water dispersion paper proposed by the present invention in order to improve water dispersion property (particularly the fiber dispersion time) and dry strength. By impregnating or coating the below-mentioned water-soluble polymer into/onto a water dispersion paper constituted by wood pulp and/or non-wood pulp containing 15 to 95 percent by weight of purified pulp that contains α-cellulose by 88 percent by weight or more (hereinafter also referred to as "base paper"), voids between fibers in the base paper are filled by the water-soluble polymer and the dry strength of the water dispersion paper increases as a result, while the water-soluble polymer in voids between fibers swells as it comes in contact with water and pushes fibers away from each other to allow for easy separation of fibers.

Under the present invention, preferred forms of the water-soluble polymer include those whose dry film easily re-dissolves in water, such as carboxy alkyl cellulose salt, alginate, pectate, polyacrylate, polymethacrylate, carboxy alkylated starch, starch phosphate, anionic polyacrylamide and other anionic polymeric electrolyte salts, methyl cellulose, hydroxyalkyl cellulose, polyvinyl alcohol, polyvinyl pyrrolidone, polyalkylene oxide, polyvinyl ethyl ether, hydroxy ethylated starch, oxidized starch, alpha starch and other polymeric non-electrolytes, cyamoposis gum, trant gum, xanthan gum, gum arabic, carrageenan, galactomannan, pullulan, dextran, dextrin and other water-soluble polysaccharides, gelatin, casein and other water-soluble proteins, etc., where any one type of the foregoing may be used or two or more types of them may be combined. Among the above, using carboxymethyl cellulose salt is preferable from the viewpoint of improving water dispersion property and strength.

Under the present invention, it is preferable, from the viewpoint of improving water dispersion property, that the water-soluble polymer permeates uniformly in the voids between fibers in the base paper. Accordingly, the water-soluble polymer to be impregnated or coated into/onto the base paper preferably has a viscosity of 1 to 20 mPa·s in 2 weight-percent aqueous solution at 20° C.

Under the present invention, the additive amount (dry weight) of the water-soluble polymer to be impregnated or coated is 2 to 14 percent by weight, or preferably 3 to 12 percent by weight, or more preferably 6 to 10 percent by weight, relative to the base paper. If the additive amount of the water-soluble polymer is less than 2 percent by weight relative to the base paper, the sufficient effect on the water dispersion property and the strength cannot be expected. If the additive amount is greater than 14 percent by weight, on the other hand, water dispersion property and strength will not improve further.

The water-soluble polymer can be added to the base paper using any method selected, as deemed appropriate, from the group that includes impregnation methods using a mangle, sizing press, etc., and surface coating methods using a gate roll coater, blade coater, bar coater, gravure coater, die coater, curtain coater, spray coater, etc.

Under the present invention, when impregnating or coating a water-soluble polymer to improve the water dispersion property and dry strength of the water dispersion paper, it is preferable that the base paper contains a water-soluble polymeric electrolyte salt so as to add enough strength to the base paper to withstand the impregnation or coating.

Under the present invention, such water-soluble polymeric electrolyte salt can be added, for example, as an aqueous solution to the slurry of paper material (purified pulp and pulp) before it is put through the papermaking process, or to the produced paper when still wet using a roll coater, curtain coater, spray coating machine, etc., and then extracting water and drying the paper.

Under the present invention, the water-soluble polymeric electrolyte salt to be contained in the base paper must have adhesion strength to boost inter-fiber bonding as well as water solubility to dissolve easily when the sheet is wetted so as to allow the fibers to separate. As long as these requirements are met, any anionic or amphoteric polymeric electrolyte salt can be used, where examples include carboxymethyl cellulose salt and other carboxy alkyl cellulose salts, alginate, carboxymethylated starch, polyacrylate, polymethacrylate, anionic polyacrylamide and amphoteric polyacrylamide, of which carboxymethyl cellulose sodium and carboxymethylated starch are preferred. Two or more types of such water-soluble polymeric electrolyte salts can be added.

Under the present invention, preferably a cationic fixer is also used in order to improve the fixation ratio of the water-soluble polymeric electrolyte salt, because purified pulp and pulp are both anionic.

This cationic fixer must have an effect of fixing the water-soluble polymeric electrolyte salt onto the base paper fibers without any loss of the water dispersion property, so for the cationic fixer, it is preferable to use a polyamine resin expressed by General Formula (I) below:

[Chemical Formula 1]

(1)

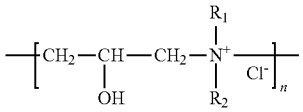

In General Formula (I), R1 represents an alkyl group with 1 to 10 carbons that may include a hydroxyl group, hydroxymethyl group, hydroxyethyl group or other substitution group (but such substitution group is not counted toward the carbon number), R2 represents a hydrogen atom or alkyl group with 1 to 10 carbons that may contain a hydroxyl group, hydroxymethyl group, hydroxyethyl group or other substitution group (but such substitution group is not counted toward the carbon number), and n represents a positive integer.

Polyamine resin, if used as the cationic fixer, has a cation equivalent of 0.1 to 20 milligram equivalent/g, or preferably 1 to 15 milligram equivalent/g, or more preferably 2 to 10 milligram equivalent/g, in a pH range of 3 to 9. The number-average molecular weight of such polyamine resin is 5000 to 100000, or preferably 5000 to 70000, or more preferably 5000 to 20000.

Under the present invention, the contents of water-soluble polymeric electrolyte salt and cationic fixer in the base paper are adjusted as deemed appropriate according to the required quality and not specifically limited, but if a water-soluble polymeric electrolyte salt and cationic fixer are added as an aqueous solution to the slurry of paper material (purified pulp and pulp) before it is put through the papermaking process, preferably their additive quantities are adjusted to the ranges specified below.

If a water-soluble polymeric electrolyte salt is used together with a cationic fixer, the additive amount (equivalent solid content) of the water-soluble polymeric electrolyte salt is preferably 0.5 to 10 percent by weight, or more preferably 2 to 6 percent by weight, of the total amount of purified pulp and pulp. If the additive amount of the water-soluble polymeric electrolyte salt is less than 0.5 percent by weight, strength does not improve much and there is no point in adding the water-soluble polymeric electrolyte salt. If the additive amount of the water-soluble polymeric electrolyte salt is greater than 10 percent by weight, on the other hand, no further improvement in strength and water dispersion property is expected.

The additive amount of the cationic fixer is preferably 0.2 to 4.0 percent by weight, or more preferably 0.5 to 2.0 percent by weight, of the total amount of purified pulp and pulp. If the additive amount of the cationic fixer is 0.2 percent by weight or less, the fixation ratio of the water-soluble polymeric electrolyte salt drops and strength needed in the subsequent processes cannot be obtained. If the additive amount of the cationic fixer is 4.0 percent by weight or more, on the other hand, excessive inter-fiber bonding in the base paper causes loss of water dispersion property (especially fiber dispersion time), which is not desirable.

Preferably the cationic fixer is added to the paper material or wet paper before the water-soluble polymeric electrolyte salt, so that cationic property is added to the fibers before the water-soluble polymeric electrolyte salt is added.

Under the present invention, it is desirable to add a water-soluble dispersant to the slurry of base paper material (purified pulp and pulp) before it is put through the papermaking process, in order to improve the formation of base material and the yield of paper material. The additive amount (equivalent solid content) of this water-soluble dispersant is preferably 0.01 to 5.0 percent by weight, or more preferably 0.1 to 1.0 percent by weight, of the total amount of purified pulp and pulp. If the additive amount of the water-soluble dispersant is less than 0.01 percent by weight, not enough improvement is expected in formation or yield of paper material and there is no point in adding the water-soluble dispersant. If the additive amount of the water-soluble dispersant is greater than 5.0 percent by weight, on the other hand, no further improvement in formation and yield of paper material is expected. The water-soluble dispersant may be cyamoposis gum, polyacrylamide, polyethylene oxide, viscous liquid of abelmoschus manihot, or the like, where two or more types of the foregoing can be added together.

[Water Dispersion Coated Paper]

The water dispersion coated paper as proposed by the present invention consists of the aforementioned water dispersion paper and a coating layer formed on top which is made by coating at least one layer of water-based coating material. The coated paper proposed by the present invention has a coated surface formed on the water dispersion paper and thus constitutes a coated printing paper that disperses in water. A sealer layer can be formed between a coating layer and the water dispersion paper. This coated paper that dissolves in water also has a pressure-sensitive adhesive layer on the back side that can be adhered and separated. Preferably these coating layer, sealer layer, printing and pressure-sensitive adhesive are made of materials and have constitutions that do not prevent dispersion in water.

The coating layer constituting the coated paper that dissolves in water as proposed by the present invention may consist of a single layer or multiple layers as long as each layer is formed by coating and drying water-soluble coating material, and the coating method, etc., are not limited in any way. Additionally any constituent material of coating layer can be selected as deemed appropriate for the press-printing method (offset press, gravure press, etc.) or printer-printing method (inkjet printer, thermo-sensitive printer, laser beam printer, etc.) used.

Examples of coating layers suitable for thermo-sensitive printer, inkjet printer and general printing are shown below.

<Sealer Layer>

The water dispersion coated paper as proposed by the present invention preferably has a sealer layer between the base material and coating layer. The primary constituents of the sealer layer are pigment and binder. Specifically, the sealer layer is provided between the base material and the coating layer which is a thermo-sensitive recording layer, under coat layer, inkjet recording layer, general printing layer, etc. The sealer layer prevents drop in operability which may be otherwise caused by permeation of excessive coating solution into the base material when the coating layer is coated, and also prevents the ions or the plasticizer, etc., contained in the pressure-sensitive adhesive from migrating into the coating layer. Because the aforementioned base material is a porous layer with weak inter-fiber bonding, providing the sealer layer embodies a thermo-sensitive recording medium whose base material offers good color development, resistance to attachment of contaminants and anti-sticking property.

If a pressure-sensitive adhesive layer is provided on the back side of the base material, the sealer layer may be provided between the back side of the base material and the pressure-sensitive adhesive layer, or on both sides of the base material.

Smoothness of the base material surface on which to coat the sealer layer is not limited in any way, but extra-smooth surface is generally preferred and Yankee dryer-contacted surface or calendered surface is used favorably.

(Composition of Sealer Layer)

In terms of its composition, the sealer layer is primarily constituted by pigment, binder and various additives.

Examples of pigment that may be used in the sealer layer are as follows: Silica, calcium carbonate, clay, kaolin, sintered kaolin, diatomaceous earth, talc, titanium oxide, aluminum hydroxide, magnesium carbonate, zinc oxide, aluminum oxide, magnesium hydroxide, barium sulfate, calcium sulfate, zinc sulfate, calcium silicate, aluminum silicate, magnesium silicate, alumino-silicate soda, magnesium alumino-silicate and other inorganic pigments; melamine resin, urea-formalin resin, polyethylene powder, nylon powder and other organic pigments; cellulose powder, carboxymethyl cellulose salt powder of 0.35 or less in substitution degree, and other polysaccharides powders.

Examples of binder used for the sealer layer are as follows: Completely-saponified polyvinyl alcohol, partially-saponified polyvinyl alcohol, carboxy-modified polyvinyl alcohol, amide-modified polyvinyl alcohol, sulfonic acid-modified polyvinyl alcohol, butylal-modified polyvinyl alcohol and other modified polyvinyl alcohols, hydroxyethyl cellulose, methyl cellulose, carboxymethyl cellulose salt, starch, gelatin, casein, sodium alginate, polyvinyl pyrrolidone, polyacrylamide, acrylamide/acrylic ester copolymer, acrylate/acrylic ester copolymer, alkali salt of styrene/maleic anhydride copolymer, alkali salt of ethylene/maleic anhydride copolymer and other water-soluble resins; polyvinyl acetate, vinyl acetate/acrylic ester copolymer, ethylene/vinyl acetate copolymer, polyacrylic ester, styrene/acrylic ester copolymer, polyurethane resin, polyvinyl butylal, polystyrene and copolymers thereof, polyamide resin, silicon resin, petroleum resin, terpene resin, ketone resin, coumarone resin and other non-water-soluble resins.

These polymeric substances are used by dissolving them in water, alcohol, ketone, ester, hydrocarbon or other solvent, or emulsifying them, or dispersed them into paste form, in water or other medium, and two or more substances may be used together according to the required quality.

Among the above, water-soluble resins and water-dispersible resins are preferred binders from the viewpoint of water dispersion property. It is desirable to use starch, hydroxyethyl cellulose, methyl cellulose, carboxymethyl cellulose salt, gelatin, casein, sodium alginate, polyvinyl alcohol, modified polyvinyl alcohol or polyvinyl pyrrolidone as the primary constituent of the binder.

The binder used for the sealer layer normally has 5 to 100 parts by weight of solid content relative to 100 parts by weight of filler.

In addition to pigment and binder, the sealer layer can also contain various additives that are customarily used. Examples of these various additives include pigment dispersant, defoaming agent, lubricant, sizing agent, preservative and wetting agent, among others.

(Coating of Sealer Layer)

The sealer layer is obtained by dispersing and mixing other additives in/with the aforementioned pigment and binder and then coating the obtained sealer using a coating machine, followed by heating and drying with a dryer. The coating amount of the sealer layer, in weight after drying, is normally 0.5 to 30 g/m$^2$, or preferably 3 to 15 g/m$^2$. The coating machine may be an air knife coater, bar coater, roll coater, blade coater, curtain coater, Champlex coater, gravure coater, etc.

<Coating Layer>

The coating layer constituting the water dispersion coated paper as proposed by the present invention may consist of a single layer or multiple layers as long as each layer is formed by coating and drying water-soluble coating material, and the coating method, etc., are not limited in any way. Additionally any constituent material of coating layer can be selected as deemed appropriate for the press-printing method (offset press, gravure press, etc.) or printer-printing method (inkjet printer, thermo-sensitive printer, laser beam printer, etc.) used.

Examples of coating layers suitable for thermo-sensitive printer, inkjet printer and general printing are shown below.

(Thermo-Sensitive Recording Medium)

The coating layer for thermo-sensitive printer is provided by forming an under coat layer and a thermo-sensitive recording layer, in this order, on top of the water dispersion paper or sealer layer coated on the water dispersion paper. Additionally, a protective layer can be provided. If the water dispersion coated paper as proposed by the present invention is to be adapted to printing by a thermo-sensitive printer, it is preferable to coat onto the aforementioned base material a under coat layer that contains pigment and binder as primary constituents, and a thermo-sensitive recording layer that contains colorless or light-colored electron-donating leuco dye and electron-receiving color developer as primary constituents, in this order.

In general, the base material surface on which to coat the under coat layer is preferably very smooth, and Yankee dryer-contacted surface or calendered surface is used favorably.

In the thermo-sensitive recording medium, the under coat layer is provided make the base material surface smoother and thereby achieve sharpness and high sensitivity of the image, and is composed of known pigment, binder and various additives.

Examples of the pigment component of the under coat layer include, among others, silica, calcium carbonate, clay, kaolin, sintered kaolin, diatomaceous earth, talc, titanium oxide, aluminum hydroxide, magnesium carbonate, zinc oxide, aluminum oxide, magnesium hydroxide, barium sulfate, calcium sulfate, zinc sulfate, calcium silicate, aluminum silicate, magnesium silicate, alumino-silicate soda, magnesium alumino-silicate and other inorganic fillers, or melamine resin filler, urea-formalin resin filler, polyethylene powder, nylon powder and other organic fillers.

For the binder component of the under coat layer, water-soluble resins or water-dispersible resins are preferred. Specific examples include starch, hydroxyethyl cellulose, methyl cellulose, carboxymethyl cellulose, gelatin, casein, sodium alginate, polyvinyl alcohol, modified polyvinyl alcohol, polyvinyl pyrrolidone, polyacrylamide, acrylamide/acrylic ester copolymer, styrene/maleic anhydride copolymer and alkali salt thereof, ethylene/maleic anhydride copolymer and alkali salt thereof, and polyacrylic soda, among others. Of these, water-soluble resins, such as starch, hydroxyethyl cellulose, methyl cellulose, carboxymethyl cellulose, gelatin, casein, sodium alginate, polyvinyl alcohol, modified polyvinyl alcohol and polyvinyl pyrrolidone, are preferred as the primary constituents of the binder from the viewpoint of water dispersion property.

The binder used for the under coat layer normally has 5 to 100 parts by weight of solid content relative to 100 parts by weight of pigment.

In addition to pigment and binder, the under coat layer can also contain various additives that are customarily used. Examples of these various additives include pigment dispersant, defoaming agent, lubricant, UV absorbent, sizing agent, sensitizer, fluorescent dye and preservative, among others.

The under coat layer is obtained by dispersing and mixing other additives in/with the aforementioned pigment and binder and then coating the obtained coating material in one layer or multiple layers using a coating machine, followed by heating and drying with a dryer. The coating amount of the under coat layer, in weight after drying, is normally 0.5 to 50 $g/m^2$, or preferably 3 to 15 $g/m^2$. The coating machine may be an air knife coater, bar coater, roll coater, blade coater, curtain coater, Champlex coater, gravure coater, etc.

The thermo-sensitive recording layer is coated on top of the under coat layer. Composition-wise, constituents of the thermo-sensitive recording layer include dye, color developer, binder and auxiliary additives.

For the dye, any known leuco dye may be used alone or two or more types of such dyes can be mixed together, where a leuco compound of triphenylmethane dye, fluoran dye, phenothiazine dye, auramine dye, spiropyran dye, indolinophthalide dye, etc., is particularly preferred.

Specific examples of dye include the following compounds: 3,3-bis(p-dimethyl aminophenyl)-phthalide, 3,3-bis(p-dimethyl aminophenyl)-6-dimethyl aminophthalide (also known as crystal violet lactone), 3,3-bis(p-dimethyl aminophenyl)-6-diethyl aminophthalide, 3,3-bis(p-dimethyl aminophenyl)-6-chlorophthalide, 3,3-bis(p-dibutyl aminophenyl) phthalide, 3-cyclohexyl amino-6-chlorofluoran, 3-dimethyl amino-5,7-dimethyl fluoran, 3-diethyl amino-7-chlorofluoran, 3-diethyl amino-7-methyl fluoran, 3-diethyl amino-7,8-benzofluoran, 3-diethyl amino-6-methyl-7-chlorofluoran, 3-(N-p-tolyl-N-ethyl amino)-6-methyl-7-anilinofluoran, 3-pyrrolidino-6-methyl-7-anilinofluoran, 2-{N-(3'-trifluoromethyl phenyl)amino}-6-diethyl aminofluoran, 2-{3,6-bis(diethyl amino)-9-(o-chloroanilino) xanthylic lactam benzoate}, 3-diethyl amino-6-methyl-7-(m-trichloromethyl anilino) fluoran, 3-diethyl amino-7-(o-chloroanilino) fluoran, 3-di-n-butyl amino-7-(o-chloroanilino) fluoran, 3-N-methyl-N, n-amyl amino-6-methyl-7-anilino fluoran, 3-N-methyl-N-cyclohexyl amino-6-methyl-7-anilinofluoran, 3-diethyl amino-6-methyl-7-anilinofluoran, 3-(N,N-diethyl amino)-5-methyl-7-(N,N-dibenzyl amino) fluoran, benzoyl leucomethylene blue, 6'-chloro-8'-methoxy-benzoindolino-spiropyran, 6'-bromo-3'-methoxy-benzoindolino-spiropyran, 3-(2'-hydroxy-4'-dimethyl aminophenyl)-3-(2'-methoxy-5'-chlorophenyl) phthalide, 3-(2'-hydroxy-4'-dimethyl aminophenyl)-3-(2'-methoxy-5'-nitrophenyl)phthalide, 3-(2'-hydroxy-4'-diethyl aminophenyl)-3-(2'-methoxy-5'-methyl phenyl)phthalide, 3-(2'-methoxy-4'-dimethyl aminophenyl)-3-(2'-hydroxy-4'-chloro-5'-methyl phenyl)phthalide, 3-(N-ethyl-N-tetrahydrofurfuryl)amino-6-methyl-7-anilinofluoran, 3-N-ethyl-N-(2-ethoxy propyl)amino-6-methyl-7-anilinofluoran, 3-N-methyl-N-isobutyl-6-methyl-7-anilinofluoran, 3-morpholino-7-(N-propyl-trifluoromethyl anilino) fluoran, 3-pyrrolidino-7-m-trifluoromethyl anilinofluoran, 3-diethyl amino-5-chloro-7-(N-benzyl-trifluoromethyl anilino) fluoran, 3-pyrrolidino-7-(di-p-chlorophenyl) methyl aminofluoran, 3-diethyl amino-5-chloro-7-(α-phenyl ethyl amino) fluoran, 3-(N-ethyl-p-toluidino)-7-α-phenyl ethyl amino) fluoran, 3-diethyl amino-7-(o-methoxy carbonyl phenyl amino) fluoran, 3-diethyl amino-5-methyl-7-(α-phenyl ethyl amino) fluoran, 3-diethyl amino-7-piperidino fluoran, 2-chloro-3-(N-methyl toluidino)-7-(p-n-butyl anilino) fluoran, 3-(N-methyl-N-isopropyl amino)-6-methyl-7-anilinofluoran, 3-di-n-butyl amino-6-methyl-7-anilinofluoran, 3,6-bis(dimethyl amino) fluolene Spiro (9,3')-6'-dimethyl amino phthalide, 3-(N-benzyl-N-cyclohexyl amino)-5,6-benzo-7-α-naphthyl amino-4'-bromofluoran, 3-diethyl amino-6-chloro-7-anilinofluoran, 3-diethyl amino-6-methyl-7-mesitidino-4',5'-benzofluoran, 3-N-methyl-N-isopropyl-6-methyl-7-anilinofluoran, 3-N-ethyl-N-isoamyl-6-methyl-7-anilinofluoran, 3-diethyl amino-6-methyl-7-(2'4'-dimethyl anilino) fluoran, etc.

The water-dispersible coated paper proposed by the present invention may be used in applications where the paper is flushed into the drain after use, so use of highly safe dye is preferable in consideration of environment. For such highly safe dye, 3-diethyl amino-6-methyl-7-anilinofluoran, 3-dibutyl amino-6-methyl-7-anilinofluoran, 3-(N-cyclohexyl-N-methyl amino)-6-methyl-7-anilinofluoran, 3-(N-ethyl-N-isopentyl amino)-6-methyl-7-anilinofluoran, 3-N-di-n-pentyl amino-6-methyl-7-anilinofluoran, 3-diethyl amino-7-(3-trifluoromethyl anilino) fluoran, 3-(N-ethyl-N-4-methyl phenyl amino)-6-methyl-7-anilinofluoran, 3-diethyl amino-6-methyl-7-(3-methyl anilino) fluoran, 3,3'-bis(dimethyl amino phenyl)-6-dimethyl amino phthalide, 3-(4-diethyl amino-2-ethoxy phenyl)-3-(1-ethyl-2-methyl indole-3-yl)-4-azaphthalide, 2-(N-phenyl-N-methyl amino)-6-(N-p-tolyl-N-ethyl amino) fluoran, 3,3-bis(1-n-butyl-2-methyl-indole-3-yl)phthalide, 1,3-dimethyl-6-diethyl amino fluoran, 3-bromo-3-methyl-6-dibutyl amino fluoran, etc., can be used favorably.

The thermo-sensitive recording layer contains color developer in addition to leuco dye. For this color developer, any phenol, organic acid, inorganic acid or ester or salt thereof can be used, among others.

Specific examples of color developer include the following compounds: Gallic acid, salicylic acid, 3-isopropyl salicylic acid, 3-cyclohexyl salicylic acid, 3,5-di-tert-butyl salicylic acid, 3,5-di-α-methyl benzyl salicylic acid, 4,4'-isopropylidene diphenol, 1,1'-isopropylidene bis(2-chlorophenol), 4,4'-isopropylidene bis(2,6-dibromo phenol), 4,4'-isopropylidene bis(2,6-dichloro phenol), 4,4'-isopropylidene bis(2-methyl phenol), 4,4'-isopropylidene bis(2,6-dimethyl phenol), 4,4-isopropylidene bis(2-tert-butyl phenol), 4,4'-sec-butylidene diphenol, 4,4'-cyclohexylidene bis phenol, 4,4'-cyclohexylidene bis(2-methyl phenol), 4-tert-butyl phenol, 4-phenyl phenol, 4-hydroxy diphenoxide, α-naphthol, β-naphthol, 3,5-xylenol, thymol, methyl-4-hydroxy benzoate, 4-hydroxy acetophenone, novolak-type phenolic resin, 2,2'-thiobis(4,6-dichlorophenol), catechol, resorcine, hydroquinone, pyrogallol, phloroglycine, phloroglycine carboxylic acid, 4-tert-octyl catechol, 2,2'-methylene bis(4-chlorophenol), 2,2'-methylene bis(4-methyl-6-tert-butyl phenol), 2,2'-dihydroxy diphenyl, ethyl p-hydroxy benzoate, propyl p-hydroxy benzoate, butyl p-hydroxy benzoate, benzyl p-hydroxy benzoate, p-chlorobenzyl p-hydroxy benzoate, o-chlorobenzyl p-hydroxy benzoate, p-methyl benzyl p-hydroxy benzoate, n-octyl p-hydroxy benzoate, benzoic acid, zinc salicylate, 1-hydroxy-2-naphthoic acid, 2-hydroxy-6-naphthoic acid, zinc 2-hydroxy-6-naphthoic acid, 4-hydroxy diphenyl sulfone, 4-hydroxy-4'-chlorodiphenyl sulfone, bis(4-hydroxy phenyl)sulfide, 2-hydroxy-p-toluic acid, zinc 3,5-di-tert-butyl salicylate, tin 3,5-di-tert-butyl salicylate, tartaric acid, oxalic acid, maleic acid, citric acid, succinic acid, stearic acid, 4-hydroxy phthalic acid, boric acid, thiourea derivative, 4-hydroxy thiophenol derivative, bis(4-hydroxy phenyl)acetate, ethyl bis(4-hydroxy phenyl)acetate, n-propyl bis(4-hydroxy phenyl)acetate, n-butyl bis(4-hydroxy phenyl)acetate, phenyl bis(4-hydroxy phenyl)acetate, benzyl bis(4-hydroxy phenyl)acetate, phenethyl bis(4-hydroxy phenyl)acetate, bis(3-methyl-4-hydroxy phenyl)acetate, methyl bis(3-methyl-4-hydroxy phenyl)acetate, n-propyl bis(3-methyl-4-hydroxy phenyl)acetate, 1,7-bis(4-hydroxy phenyl thio) 3,5-dioxaheptane, 1,5-bis(4-hydroxy phenyl thio) 3-oxapentane, dimethyl 4-hydroxy phthalate, 4-hydroxy-4'-methoxy diphenyl sulfone, 4-hydroxy-4'-ethoxy diphenyl sulfone, 4-hydroxy-4'-isopropoxy diphenyl sulfone, 4-hydroxy-4'-propoxy diphenyl sulfone, 4-hydroxy-4'-butoxy diphenyl sulfone, 4-hydroxy-4'-isobutoxy diphenyl sulfone, 4-hydroxy-4'-sec-butoxy diphenyl sulfone, 4-hydroxy-4'-tert-butoxy diphenyl sulfone, 4-hydroxy-4'-benzyloxy diphenyl sulfone, 4-hydroxy-4'-phenoxy diphenyl sulfone, 4-hydroxy-4'-(m-methyl benzyloxy)diphenyl sulfone, 4-hydroxy-4'-(p-methyl benzyloxy)diphenyl sulfone, 4-hydroxy-4'-(o-methyl benzyloxy) diphenyl sulfone, 4-hydroxy-4'-(p-chlorobenzyloxy)diphenyl sulfone, etc.

The water-dispersible coated paper proposed by the present invention may be used in applications where the paper is flushed into the drain after use. Environmentally safe color developers that can be used include, among others, color developer compositions that contain 4,4'-dihydroxy diphenyl sulfone, 2,4'-dihydroxy diphenyl sulfone, 4-hydroxy-4'-isopropoxy diphenyl sulfone, benzyl para-hydroxy benzoate, 4-hydroxy-4'-propoxy diphenyl sulfone, 3-{[(phenyl amino) carbonyl]amino}benzene sulfone amide, N-(4'-hydroxy phenyl thio)acetyl-2-hydroxy aniline, 1:1 mixture of N-(4'-hydroxy phenyl thio)acetyl-4-hydroxy aniline and N-(4'-hydroxy phenyl thio)acetyl-2-hydroxy aniline, 4,4'-bis (3-(phenoxy carbonyl amino)methyl phenyl ureido)diphenyl sulfone and 2,2'-bis[4-(4-hydroxy phenyl sulfone) phenoxy] diphenyl ether; and condensed compositions that contain 2,2'-methylene bis(4-t-butyl phenol) by 55% (specifically, condensed compositions that contain 2,2'-methylene bis(4-t-butyl phenol) by 55%, with the remainder being corresponding 3-nuclear condensation product (29%), 4-nuclear condensation product (11%), 5-nuclear condensation product (4%) and other (1%)).

For the binder, any known binder can be used.

Specific examples of binder include, among others, completely-saponified polyvinyl alcohol, partially-saponified polyvinyl alcohol, carboxy-modified polyvinyl alcohol, amide-modified polyvinyl alcohol, sulfonic acid-modified polyvinyl alcohol, butylal-modified polyvinyl alcohol and other modified polyvinyl alcohols, hydroxyethyl cellulose, methyl cellulose, carboxymethyl cellulose, starch, gelatin, casein, sodium alginate, polyvinyl pyrrolidone, polyacrylamide, acrylamide/acrylic ester copolymer, alkali salt of styrene/maleic anhydride copolymer, alkali salt of ethylene/maleic anhydride copolymer and other water-soluble resins, styrene-butadiene copolymer, acrylonitrile/butadiene copolymer, methyl acrylate/butadiene copolymer, acrylonitrile/butadiene/styrene tertiary copolymer, ethyl cellulose, acetyl cellulose and other cellulose derivatives, polyvinyl chloride, polyvinyl acetate, vinyl acetate/acrylic ester copolymer, ethylene/vinyl acetate copolymer, polyacrylic ester, styrene/acrylic ester copolymer, polyurethane resin, polyvinyl butylal, polystyrol and copolymers thereof, polyamide resin, silicon resin, petroleum resin, terpene resin, ketone resin, coumarone resin and other non-water-soluble resins.

These polymeric substances are used by dissolving them in water, alcohol, ketone, ester, hydrocarbon or other solvent, or emulsifying them, or dispersed them into paste form, in water or other medium, and two or more substances may be used together according to the required quality.

For the binder, it is preferable, among the above, to use water-soluble resin as the primary constituent, such as starch, hydroxyethyl cellulose, methyl cellulose, carboxymethyl cellulose, gelatin, casein, sodium alginate, polyvinyl alcohol, modified polyvinyl alcohol or polyvinyl pyrrolidone, from the viewpoint of water dispersion property.

For the thermo-sensitive recording layer, auxiliary additive components are used, as necessary, along with the aforementioned leuco dye, color developer and binder. For these auxiliary components, sensitizers, pigments, p-nitrobenzoate metal salts (Ca, Zn), monobenzyl ester phthalate metal salts (Ca, Zn) and other stabilizers, aliphatic metal salts and other mold release agents, waxes and other lubricants, pressure/color development inhibitors, benzophenone-type or triazol-type UV absorbents, glyoxal and other water-proofing agents, dispersants, and defoaming agents can be used, for example.

For sensitizers that improve thermal response, thermo-fusible substances, or specifically thermo-fusible organic compounds having a melting point of approx. 50 to 200° C., can be used.

Specific examples of sensitizer include, among others, stearic amide, palmitic amide, N-hydroxy methyl stearic amide, N-stearyl stearic amide, ethylene bis-stearic amide, N-stearyl urea, benzyl-2-naphthyl ether, m-terphenyl, 4-benzyl biphenyl, 2,2'-bis(4-mthoxy phenoxy) diethyl ether, α,α'-diphenoxy xylene, bis(4-methoxy phenyl)ether, diphenyl azipate, dibenzyl oxalate, di(4-chlorobenzyl) oxalate ester, dimethyl terephthalate, dibenzyl terephthalate, phenyl benzene sulfonate ester, bis(4-aryl oxy phenyl) sulfone, 4-acetyl acetophenone, anilide acetoacetates, aliphatic anilides, montan wax, polyethylene wax, benzyl p-benzyl oxy benzoate, di-p-tolyl carbonate, phenyl-α-naphtyl carbonate, 1,4-diethoxy naphthalene, phenyl 1-hydroxy-2-naphthoate ester, 1,2-di-(3-methyl phenoxy) ethane, di(p-methyl benzyl) oxalate, β-benzyl oxy naphthalene, 4-biphenyl p-tolyl ether, o-xylylene-bis-(phenyl ether) and 4-(m-methyl phenoxy methyl) biphenyl.

The water-dispersible coated paper proposed by the present invention may be used in applications where the paper is flushed into the drain after use. In consideration of environment, highly safe sensitizers such as stearic amide, palmitic amide, ethylene bis-stearoamide, benzyl parabenzyl oxy benzoate, 4-biphpenyl paratolyl ether, bis(paramethyl benzyl) oxalate, bis(parachlorobenzyl) oxalate, parabenzyl biphenyl, 1,2-bis(phenoxy methyl)benzene, paratoluene sulfone amide, orthotoluene sulfone amide, diphenyl sulfone, benzyl oxy naphthalane, paraphenyl acetophenone and 1,2-bis(3-methyl phenoxy) ethane are desirable.

Examples of pigment include, among others, silica, calcium carbonate, clay, kaolin, sintered kaolin, diatomaceous earth, talc, titanium oxide, aluminum hydroxide, magnesium carbonate, zinc oxide, aluminum oxide, magnesium hydroxide, barium sulfate, calcium sulfate, zinc sulfate, calcium silicate, aluminum silicate, magnesium silicate, alumino-silicate soda, magnesium alumino-silicate and other inorganic fillers; and melamine resin filler, urea-formalin resin filler, polyethylene powder, nylon powder and other organic fillers.

The amounts of organic color developer and leuco dye, and types and amounts of other various constituents, are determined according to the required performance and recordability and not limited in any way. Normally it is appropriate to use 0.5 to 10 parts by weight of organic color developer and 0.5 to 10 parts by weight of sensitizer, relative to 1 part by weight of leuco dye, and use 5 to 50 percent by weight of binder relative to the total solid content.

The aforementioned organic color developer, leuco dye and other materials to be added as necessary are atomized to particle size of several microns or less using a ball mill, attritor, sand grinder or other crusher or appropriate emulsifier, after which binder and various additive materials are added according to the purpose and mixed into a coating solution.

The method for forming the thermo-sensitive recording layer is not limited in any way. For example, the thermo-sensitive recording layer can be formed by coating a coating material onto the base material using planographic printing or any one of various other printing methods or by means of air knife coating, rod blade coating, bar coating, blade coating, gravure coating, curtain coating, etc., and then drying the coated material. The coating amount of coating solution is normally in a range of approx. 2 to 12 g, or preferably in a range of approx. 3 to 10 g.

A protective layer can be provided on the thermo-sensitive recording layer. Such protective layer can improve the compatibility with the thermal head, etc., and preservability of recorded images. Constituents of the protective layer include binder and various additives, among others.

For the binder of the protective layer, any of the same types of binder mentioned above for the thermo-sensitive recording layer can be used.

Specific examples include completely-saponified polyvinyl alcohol, partially-saponified polyvinyl alcohol, carboxy-modified polyvinyl alcohol, amide-modified polyvinyl alcohol, sulfonic acid-modified polyvinyl alcohol, butylal-modified polyvinyl alcohol and other modified polyvinyl alcohols, hydroxyethyl cellulose, methyl cellulose, carboxymethyl cellulose, starch, gelatin, casein, sodium alginate, polyvinyl pyrrolidone, polyacrylamide, acrylamide/acrylic ester copolymer, alkali salt of styrene/maleic anhydride copolymer, alkali salt of ethylene/maleic anhydride copolymer and other water-soluble resins, styrene-butadiene copolymer, acryronitrile/butadiene copolymer, methyl acrylate/butadiene copolymer, acrylonitrile/butadiene/styrene tertiary copolymer, ethyl cellulose, acetyl cellulose and other cellulose derivatives, polyvinyl chloride, polyvinyl acetate, vinyl acetate/acrylic ester copolymer, ethylene/vinyl acetate copolymer, polyacrylic ester, styrene/acrylic ester copolymer, polyurethane resin, polyvinyl butylal, polystyrol and copolymers thereof, polyamide resin, silicon resin, petroleum resin, terpene resin, ketone resin, coumarone resin and other non-water-soluble resins. These polymeric substances are used by dissolving them in water, alcohol, ketone, ester, hydrocarbon or other solvent, or emulsifying them, or dispersed them into paste form, in water or other medium, and two or more substances may be used together according to the required quality. For the binder, it is preferable, among the above, to use water-soluble resin as the primary constituent, such as starch, hydroxyethyl cellulose, methyl cellulose, carboxymethyl cellulose, gelatin, casein, sodium alginate, polyvinyl alcohol, modified polyvinyl alcohol or polyvinyl pyrrolidone, from the viewpoint of water dispersion property.

Examples of various additives used for the protective layer include fillers, surface active agents, thermo-fusible substances (or lubricants) and pressure/color development inhibitors, among others.

Here, the specific examples of filler and thermo-fusible substance are the same as those cited for the thermo-sensitive recording layer above.

The protective layer is obtained by dispersing and mixing various additives in/with the aforementioned binder and then coating the obtained coating material in one layer or multiple layers using a coating machine, followed by heating and drying with a dryer. The coating amount of coating material, in weight after drying, is normally 0.2 to 10 g/m$^2$, or preferably 0.5 to 5 g/m$^2$. The coating machine is not limited in any way and an air knife coater, bar coater, roll coater, blade coater, curtain coater, Champlex coater, gravure coater or any other known coating machine can be used.

Under the present invention, it is preferable to increase the surface smoothness of the thermo-sensitive recording layer using a calender, super calender, soft nip calender or other smoothing machine for the purpose of improving the sharpness of image and sensitivity. The Beck smoothness of thermo-sensitive recording layer surface is preferably 50 to 2000 s, or more preferably 100 to 2000 s. If the Beck smoothness is less than 50 s, the smoothing process will have no effect as any improvement in printed image quality will be minimal. If the Beck smoothness exceeds 2000 s, on the other hand, water dispersion property will drop notably due to improved density of the base material, which is undesirable.

(Inkjet Recording Medium)

For the coating layer for inkjet printer, it is appropriate to form a pigment coat layer or clear coat layer on top of the water dispersion paper or on top of the sealer layer coated on the water dispersion paper proposed by the present invention. Composition-wise, pigment and water-based binder are the primary constituents of the pigment coat layer. Cationic resin and/or water-based binder is/are the primary constituent(s) of the clear coat layer. Various additives can be blended in as deemed appropriate. Their blending amounts can be adjusted as deemed appropriate according to the required quality.

Examples of pigment in the pigment coat layer include silica, colloidal silica, calcium carbonate, clay, kaolin, sintered kaolin, diatomaceous earth, talc, titanium oxide, aluminum hydroxide, magnesium carbonate, zinc oxide, aluminum oxide, magnesium hydroxide, barium sulfate, calcium sulfate, zinc sulfate, calcium silicate, aluminum silicate, magnesium silicate, alumino-silicate soda, magnesium alumino-silicate, calcium carbonate combined silica and other inorganic fillers, or melamine resin filler, urea-formalin resin filler, polyethylene powder, nylon powder, styrene, styrene-acrylic, acrylic and other organic fillers. Of those, silica, alumina, sintered kaolin and calcium carbonate are preferred from the viewpoints of ink absorbency and color development property.

For the binder for the pigment coat layer and/or clear coat layer, water-soluble resins or water-dispersible resins are preferred, where specific examples include starch, hydroxyethyl cellulose, methyl cellulose, carboxymethyl cellulose, gelatin, casein, sodium alginate, polyvinyl alcohol, modified polyvinyl alcohol, polyvinyl pyrrolidone, polyacrylamide, acrylamide/acrylic ester copolymer, styrene/maleic anhydride copolymer and alkali salt thereof, ethylene/maleic anhydride copolymer and alkali salt thereof, styrene/butadiene copolymer, pollyacrylate soda, vinyl acetate, ethylene-vinyl acetate, acrylate copolymer, methacrylate copolymer and acrylate/methacrylate copolymer, among others. Of those, polyvinyl alcohol and modified polyvinyl alcohol, among others, are preferred from the viewpoints of ink absorbency and color development property.

Examples of various additives include cationic resin (dye fixer), pigment dispersant, defoaming agent, lubricant, UV absorbent, sizing agent, fluorescent dye and preservative, among others. Of those, it is preferable to use cationic resin as it significantly improves the water resistance and color development property of image.

The coating machine is not limited in any way, and an air knife coater, bar coater, roll coater, blade coater, curtain coater, cast coater, Champlex coater, gravure coater, 2-roll coater, transfer roll coater, etc., can be used.

(General Printing)

As a coating layer suitable for offset printing and gravure printing, it is appropriate to provide a pigment coat layer or clear coat layer. Constitution-wise, pigment and water-based binder are the primary constituents of the pigment coat layer. Water-based binder is the primary constituent of the clear coat layer. Various additives can also be blended in as deemed appropriate. Their blending amounts can be adjusted as deemed appropriate according to the required quality.

Examples of pigment in the pigment coat layer include calcium carbonate, clay, kaolin, sintered kaolin, diatomaceous earth, talc, titanium oxide, aluminum hydroxide, magnesium carbonate, zinc oxide, aluminum oxide, magnesium hydroxide, barium sulfate, calcium sulfate, zinc sulfate, calcium silicate, aluminum silicate, magnesium silicate, alumino-silicate soda, magnesium alumino-silicate, silica, colloidal silica, calcium carbonate combined silica and other inorganic fillers, or melamine resin filler, urea-formalin resin filler, polyethylene powder, nylon powder, styrene, styrene-acrylic, acrylic and other organic fillers.

For the binder for the pigment coat layer and/or clear coat layer, water-soluble resins or water-dispersible resins are preferred. Specific examples include starch, hydroxyethyl cellulose, methyl cellulose, carboxymethyl cellulose, gelatin, casein, sodium alginate, polyvinyl alcohol, modified polyvinyl alcohol, polyvinyl pyrrolidone, polyacrylamide, acrylamide/acrylic ester copolymer, styrene/maleic anhydride copolymer and alkali salt thereof, ethylene/maleic anhydride copolymer and alkali salt thereof, styrene/butadiene copolymer, pollyacrylate soda, vinyl acetate, ethylene-vinyl acetate, acrylate copolymer, methacrylate copolymer and acrylate/methacrylate copolymer, among others. It is preferable, among the above, to include water-soluble resin as the binder, such as starch, hydroxyethyl cellulose, methyl cellulose, carboxymethyl cellulose, gelatin, casein, sodium alginate, polyvinyl alcohol, modified polyvinyl alcohol or polyvinyl pyrrolidone, from the viewpoint of water dispersion property.

Examples of various additives include cationic resin (printability improving agent), pigment dispersant, defoaming agent, lubricant, UV absorbent, sizing agent, fluorescent dye and preservative, among others.

The coating machine is not limited in any way, and an air knife coater, bar coater, roll coater, blade coater, curtain coater, cast coater, Champlex coater, gravure coater, 2-roll coater, transfer roll coater, etc., can be used.

<Pressure-Sensitive Adhesive Layer>

The pressure-sensitive adhesive layer is provided on the opposite side of the water dispersion paper surface on which the coating layer is provided. The water-dispersible coated paper proposed by the present invention can be used as a pressure-sensitive adhesive sheet or label by providing a pressure-sensitive adhesive layer on top of the opposite side of the coating layer (i.e., press-printed surface or printer-printed surface) or on top of the sealer layer coated on the opposite side. For the pressure-sensitive adhesive to constitute this pressure-sensitive adhesive layer, suitable choices are water-soluble or water-redispersible pressure-sensitive adhesives, particularly acrylic pressure-sensitive adhesives.

Examples of water-soluble acrylic pressure-sensitive adhesive include those that contain, as the base polymer, a copolymer of alkoxy alkyl acrylate and styrene sulfonate or other copolymeric monomer, or copolymer of (meth)acrylate or other carboxyl-group-containing vinyl monomer and hydroxyl-group-containing monomer or other polymerable monomer that can be used depending on the purpose, among others. Additionally, examples of water-redispersible acrylic pressure-sensitive adhesive include those that contain, as the base polymer, a copolymer of (meth)acrylate alkyl ester, carboxyl-group-containing vinyl monomer, alkoxy-group-containing vinyl monomer and other polymerable monomer that can be used depending on the purpose, or copolymer of carboxylated-rosin-ester-containing vinyl monomer, carboxyl-group-containing vinyl monomer and water-soluble vinyl monomer, among others. The carboxyl groups in these copolymers may be partially or fully alkali-neutralized salts, as necessary, where alkali metal salts, amine salts and alkanol amine salts are suitable choices.

Cross-linking agent can be blended into these acrylic pressure-sensitive adhesives in order to adjust the pressure-sensitive adhesive force and water solubility or water dispersion property. Such cross-linking agent is not specifically limited, and any of the cross-linking agents customarily used in conventional acrylic pressure-sensitive adhesives can be selected and used as deemed appropriate.

Examples include, among others, 1,2-ethylene diisocyanate and other isocyanate cross-linking agents, diglycidylethers and other epoxy cross-linking agents, melamine resin, urea resin, dialdehydes, methylol polymer, metal chelate compound, metal alkoxide and metal salts.

It is also possible to blend into the aforementioned acrylic pressure-sensitive adhesive, any known plasticizer, pressure-sensitive adhesiveness adding agent, colorant, thickener, defoaming agent, leveling agent, plasticizer, fungicide, antioxidant, etc., as deemed appropriate, in order to adjust the property and improve the performance if necessary.

Here, plasticizer and pressure-sensitive adhesiveness adding agent are preferably water-soluble or water-dispersible. Examples of plasticizer include sugar alcohol and other polyhydric alcohols, and polyether polyol, rosin oxidize and other alkanol amine salts, among others. Examples of pressure-sensitive adhesiveness adding agent include rosin, disproportionating rosin, hydrogenated rosin and other alkali metal salts, ammonium salt, and polyether ester, among others.

Any such pressure-sensitive adhesive agent can be directly coated onto the non-coated surface of the base material to provide a pressure-sensitive adhesive layer. Alternately, pressure-sensitive adhesive can be applied onto the release-agent-coated surface of a backing sheet to provide a pressure-sensitive adhesive layer, after which the layer can be pressured and thus transferred onto the non-coated surface. Whichever method is used, the pressure-sensitive adhesive layer can have a backing sheet attached to it, so that the backing sheet is removed as desired for use, so as to prevent unnecessary adhesion when the layer is not in use.

The coating amount of the pressure-sensitive adhesive layer provided on the base material is 3 to 60 g/m$^2$, or preferably 10 to 50 g/m$^2$ or so, in solid content. If the coating amount of pressure-sensitive adhesive is less than 5 g/m$^2$, the pressure-sensitive adhesive sheet will not exhibit enough adhesion performance. If the coating amount of pressure-sensitive adhesive exceeds 60 g/m$^2$, on the other hand, pressure-sensitive adhesive will easily run off during the manufacturing of pressure-sensitive adhesive sheet or in the subsequent processing steps, which is not desirable.

EXAMPLES

The present invention is explained specifically below using examples. It should be noted, however, that the present invention is not limited to those examples in any way. The evaluation methods used in the examples are described below. These methods were used in all examples.

1) Water Dispersion Time

Five test pieces, each of 3×3 cm square, were prepared. Next, 300 ml of deionized water was put in a 300-ml beaker and one of the test pieces was introduced while agitating the water with a stirrer at 650 rpm. A stopwatch was used to measure the time until the test piece tears into two or more pieces and the time until it completely disintegrates into fibers, and the averages of five measurements were taken as the floc water dispersion time and fiber water dispersion time, respectively.

2) Tensile Strength

Tensile strength was measured according to JIS P 8113.

3) Printability

Solid printing was performed using a flexo-press (K Printing Proofer manufactured by Matsuo Sangyo) and the condition of paper surface was evaluated in terms of lint and fiber detachment. For the ink, solvent-type flexo-ink (H151UPF manufactured by Toyo Ink, Zahn cup No. 4, 25° C., 30 seconds) was used.

Evaluation standards

◎: Good solid-printing result

○: Printing does not produce any problem affecting practical use

Δ: Paper surface had lint

×: Fibers attached to the rubber printing roll

4) Paper Surface pH

Paper surface pH was measured according to JAPAN TAPPI No. 49-1, or specifically by dripping wetting agent, or distilled water, onto the paper, causing the wet paper surface to contact electrodes and waiting for 2 minutes, and then reading the pH value.

5) Yellowing Level

A test piece of 25×25 cm square was prepared according to JIS K 7103 and its yellowness was measured using Suga Tester's SM Color Computer, after which the test piece was stored for 7 days in a dark place at 23° C. and 50% RH. Thereafter, yellowness was measured and the yellowness before storage was subtracted from the yellowness after storage, to obtain the yellowing level.

Evaluation Standards

○: If the yellowing level was less than 1, "○" was given to indicate that no yellowing occurred.

×: If the yellowing level was 1 or greater, "X" was given to indicate that yellowing occurred.

6) Printability (Text-Specific)

6-1) Thermo-Sensitive Recording Paper (Evaluation Using a Thermo-Sensitive Printer)

Zebra's "Barcode Printer 140 Xill" was used to print on the water-dispersible coated papers produced per Examples 13 through 22, 25 and Comparative Examples 5 through 9.

The reflective densitometer "Macbeth RD-918" was used to measure the surface texture of printed and unprinted areas of the sample printed with the thermal head energy of 0.2 mJ.

Evaluation Standards

○: If the measured values of printed areas were high, indicating excellent color development sensitivity, while the measured values of unprinted areas were low, indicating minimal surface coverage and excellent thermal printability (text-specific), "○" was given.

×: If the measured values of surface texture were low in printed areas and high in unprinted areas, "X" was given to indicate poor thermal printability (text-specific).

6-2) Inkjet Recording Paper (Evaluation Using an Inkjet Printer)

Epson's "PM-970C" was used to perform solid printing (black) on the water-dispersible coated paper produced per Example 23, and printing density was measured using the reflective densitometer "Macbeth RD-918." The same printer was used to print "電" (a Chinese character) in font 8, and ink seepage was visually evaluated according to the standards below.

Evaluation Standards

○: If ink was little seeped in the printed area or seeped slightly but the character could be discriminated without problem, "○" was given to indicate excellent inkjet printability.

×: If ink seeped in the printed area and there was problem discriminating the character, "X" was given to indicate poor inkjet printability.

6-3) Printability

Solid printing was performed using a flexo-press (K Printing Proofer manufactured by Matsuo Sangyo) and the condition of paper surface was evaluated in terms of lint and fiber detachment. For the ink, alcohol flexo-ink (FB King X manufactured by Toyo Ink) was used.

Evaluation Standards

○: Good solid-printing result

Δ: Paper surface had lint

×: Fibers attached to the rubber printing roll

7) Pressure-Sensitive Adhesion Strength

Pressure-sensitive adhesive was coated on the unprinted (text-specific) side or unprinted side of the base material and the coated base material was processed into a pressure-sensitive adhesive sheet or label, and its pressure-sensitive adhesion strength was evaluated as described below.

7-1) Preparation of Test Piece

An applicator bar was used to coat pressure-sensitive adhesive (Riki-Dyne manufactured by VIGteQnos) onto a silicone-coated side of the silicone-coated backing paper (manufactured by Lintec) to a dry weight of 30 g/m$^2$, after which the adhesive was dried to form a pressure-sensitive adhesive layer.

After aligning the pressure-sensitive adhesive-coated side of the backing paper with the unprinted (text) side of the base material, a rubber roller weighing 3 kg was rolled back and forth over them twice to pressure-bond, after which the obtained piece was stored for 60 days in a room at 23° C. and 50% RH.

7-2) Pressure-Sensitive Adhesion Strength Test

Pressure-sensitive adhesive was coated according to JIS Z 0237 and on day 60 thereafter, three test pieces, each of 25 mm in width and 170 mm in length, were cut out. After removing the backing paper, each test piece was placed on a stainless sheet (100×150 mm) with the adhesive-coated side contacting the stainless sheet, and then a rubber roller weighing 3 kg was rolled back and forth over it twice to pressure-bond the test piece.

The stainless sheet was clamped with the bottom chuck of the tensile tester and one side of the test piece was clamped with the top chuck, and then pull-off test was conducted at a pulling speed of 300 mm/min, after which pressure-sensitive adhesion strength was measured.

Evaluation Standards

○: If the pressure-sensitive adhesion strength was 200 g/m2 or more, "○" was given to indicate minimal drop in pressure-sensitive adhesion strength over time, making the paper usable as a pressure-sensitive adhesive sheet.

×: If the pressure-sensitive adhesion strength was less than 200 g/m2, "○" was given to indicate significant drop in pressure-sensitive adhesion strength over time, making the paper not practically usable as a pressure-sensitive adhesive sheet.

EXAMPLE 1

Sixty percent by weight of needle-leaved bleached kraft pulp (hereinafter referred to as "NBKP," containing α-cellulose by 85.6 percent) and 40 percent by weight of purified pulp being needle-leaved mercerized pulp (containing α-cellulose by 97.5 percent, water retention level 138 percent at 450 ml CSF) were blended together and then mixed and beaten to a freeness of 641 ml CSF to obtain a papermaking material, to which polyamine resin (Arkofix 159 manufactured by Ciba Specialty Chemicals) was added as cationic fixer by 0.9 percent by weight relative to the material in equivalent solid content, along with aqueous solution of carboxylmethyl cellulose sodium salt (hereinafter referred to as "CMC"; Sunrose manufactured by Nippon Paper Industries Chemical Division) as water-soluble polymeric electrolyte salt by 2.0 percent by weight in equivalent solid content, after which the mixture was used to manually make a water dispersion paper of 60 g/m$^2$ in weight. Table 1 shows the measured results of water dispersion time, tensile strength, printability and paper surface pH of this water dispersion paper.

EXAMPLE 2

A water dispersion paper was produced in the same manner as in Example 1, except that the blending amounts of NBKP and mercerized pulp were changed as shown in Table 1.

EXAMPLE 3

A water dispersion paper was produced in the same manner as in Example 1, except that the blending amounts of NBKP and mercerized pulp were changed as shown in Table 1.

EXAMPLE 4

A water dispersion paper was produced in the same manner as in Example 1, except that the blending amounts of NBKP and mercerized pulp were changed as shown in Table 1.

EXAMPLE 5

A water dispersion paper was produced in the same manner as in Example 1, except that, instead of mercerized pulp, broad-leaved dissolving pulp obtained by sulfite cooking (containing α-cellulose by 92.0 percent, water retention level 58 percent at 450 ml CSF) was blended in as purified pulp.

EXAMPLE 6

A water dispersion paper was produced in the same manner as in Example 1, except that, instead of mercerized pulp, broad-leaved dissolving pulp obtained by sulfite cooking (containing α-cellulose by 89.0 percent, water retention level 120 percent at 450 ml CSF) was blended in as purified pulp.

EXAMPLE 7

A water dispersion paper was produced in the same manner as in Example 1, except that the amount of CMC added to the papermaking material was changed to 6.0 percent by weight.

EXAMPLE 8

A water dispersion paper was produced in the same manner as in Example 1, except that the blending amount of cationic fixer was changed as shown in Table 1.

EXAMPLE 9

A water dispersion paper was produced in the same manner as in Example 1, except that the blending amount of cationic fixer was changed as shown in Table 1.

EXAMPLE 10

A water dispersion paper was produced in the same manner as in Example 1, except that the blending amount of cationic fixer was changed as shown in Table 1.

EXAMPLE 11

A water dispersion paper was produced in the same manner as in Example 2, except that the blending amounts of cationic fixer and polymeric electrolyte salt were changed as shown in Table 1.

EXAMPLE 12

A water dispersion paper was produced in the same manner as in Example 2, except that the blending amounts of cationic fixer and polymeric electrolyte salt were changed as shown in Table 1.

Comparative Example 1

A water dispersion paper was produced in the same manner as in Example 1, except that only NBKP (containing α-cellulose by 85.6 percent by weight) was used, with no purified pulp blended into the papermaking material.

As no purified pulp was blended in, inter-fiber bonding of paper material fibers was too strong, which made the fiber water dispersion time too long and consequently the obtained water dispersion paper did not have excellent water dispersion property.

Comparative Example 2

A water dispersion paper was produced in the same manner as in Example 1, except that only needle-leaved mercerized pulp (containing α-cellulose by 97.5 percent by weight, water retention level 138 percent at 450 ml CSF) was used, with no papermaking fibers blended into the papermaking material.

As the papermaking material only contained purified pulp, inter-fiber bonding of paper material fibers was weak and sufficient paper strength was not obtained, resulting in low printability.

Comparative Example 3

Forty percent by weight of NBKP (containing α-cellulose by 85.6 percent) and 60 percent by weight of fiber carboxylmethyl cellulose Na salt pulp (substitution degree 0.28) were blended together and then mixed and beaten to a freeness of 648 ml CSF, and the obtained papermaking material was used to manually make a base paper of 60 g/m$^2$ in weight.

The sheet had a neutral paper surface pH of 6.9, but its floc water dispersion time was 264 seconds, which was too long to call the paper "water dispersion paper."

Comparative Example 4

A water dispersion paper was produced in the same manner as in Example 1, except that regenerated cellulose fiber (3.3 dtex×5 mm) was blended in instead of mercerized pulp.

Although the paper surface pH was neutral at 6.8 and water dispersion property was good, the printability test found printability problems caused by detachment of regenerated cellulose fibers. The regenerated cellulose fibers were highly purified and α-cellulose content was high, but the fiber surface was smooth and did not fibrillate easily, which led to poor inter-fiber bonding and behaviors different from what are normally expected from pulp fibers. Accordingly, the problem is that fibers produced lint and detached often.

Example 1A

A water-soluble polymer constituted by a solution containing 4 percent by weight of CMC (Sunrose manufactured by Nippon Paper Industries Chemical Division, 5 mPa·s viscosity in 2 weight-percent aqueous solution at 20° C.) was coated onto the water dispersion paper (base paper) produced in Example 1 by 9.3 percent by weight (5.6 g/m$^2$) relative to the base paper, using the sizing press method, to produce a water dispersion paper of Example 1A.

Table 2 shows the measured results of water dispersion time, tensile strength, printability and paper surface pH of this water dispersion paper.

The water dispersion paper obtained in Example 1A was superior in terms of floc water dispersion time and fiber water dispersion time.

Example 1B

A water dispersion paper was produced in the same manner as in Example 1A with the water dispersion paper produced in Example 1 being used as the base paper, except that additive ratio of water-soluble polymer was changed as shown in Table 2.

Example 2A

A water dispersion paper was produced in the same manner as in Example 1A, except that the water dispersion paper produced in Example 2 was used as the base paper and additive ratio of water-soluble polymer was changed as shown in Table 2.

Example 3A

A water dispersion paper was produced in the same manner as in Example 1A, except that the water dispersion paper produced in Example 3 was used as the base paper.

Example 4A

A water dispersion paper was produced in the same manner as in Example 1A, except that the water dispersion paper produced in Example 4 was used as the base paper and additive ratio of water-soluble polymer was changed as shown in Table 2.

Example 5A

A water dispersion paper was produced in the same manner as in Example 1A, except that the water dispersion paper produced in Example 5 was used as the base paper and additive ratio of water-soluble polymer was changed as shown in Table 2.

Example 6A

A water dispersion paper was produced in the same manner as in Example 1A, except that the water dispersion paper produced in Example 6 was used as the base paper and additive ratio of water-soluble polymer was changed as shown in Table 2.

Example 7A

A water dispersion paper was produced in the same manner as in Example 1A, except that the water dispersion paper produced in Example 7 was used as the base paper.

Example 11A

A water dispersion paper was produced in the same manner as in Example 1A, except that the water dispersion paper produced in Example 11 was used as the base paper and additive ratio of water-soluble polymer was changed as shown in Table 2.

Example 12A

A water dispersion paper was produced in the same manner as in Example 1A, except that the water dispersion paper produced in Example 12 was used as the base paper and additive ratio of water-soluble polymer was changed as shown in Table 2.

Comparative Example 1A

A water dispersion paper was produced in the same manner as in Example 1A, except that the water dispersion paper produced in Comparative Example 1 was used as the base paper and additive ratio of water-soluble polymer was changed as shown in Table 2.

Comparative Example 2A

An attempt was made to coat the water dispersion paper produced in Comparative Example 2 in the same manner as in Example 1A, but the base paper tore in the sizing press process and water dispersion paper could not be obtained.

TABLE 1

| | Examples | | | | | | | |
|---|---|---|---|---|---|---|---|---|
| | 1 | 2 | 3 | 4 | 5 | 6 | 7 | 8 |
| NBKP blending ratio % | 60 | 40 | 80 | 10 | 60 | 60 | 60 | 60 |
| Blending ratio of high α-cellulose pulp % | 40 | 60 | 20 | 90 | 40 | 40 | 40 | 40 |
| α-cellulose content of high α-cellulose pulp % | 97.5 | 97.5 | 97.5 | 97.5 | 92.0 | 89.0 | 97.5 | 97.5 |
| Freeness of blended pulp mlCSF | 641 | 641 | 635 | 645 | 633 | 636 | 641 | 641 |
| Additive ratio of cationic fixer % | 0.9 | 0.9 | 0.9 | 0.9 | 0.9 | 0.9 | 0.9 | 2 |
| Additive ratio of polymeric electrolyte salt % | 2.0 | 2 | 2 | 2 | 2 | 2 | 6 | 2 |
| Tensile strength of base paper kN/m | 2.55 | 1.73 | 3.38 | 0.56 | 2.49 | 3.09 | 2.48 | 2.18 |
| Wet tensile strength of base paper kN/m | 0.039 | 0.026 | 0.055 | 0.014 | 0.061 | 0.068 | 0.055 | 0.030 |
| Floc dispersion time sec | 22 | 9 | 23 | 4 | 11 | 19 | 10 | 7 |
| Fiber dispersion time sec | 297 | 192 | 300 | 28 | 277 | 300 | 124 | 62 |
| Paper surface pH | 6.4 | 6.8 | 6.7 | 6.9 | 7.0 | 6.9 | 6.8 | 6.8 |
| Printability | ○ | ○ | ◎ | ○~Δ | ○ | ◎ | ○ | ○ |

| | Examples | | | | Comparative Examples | | | |
|---|---|---|---|---|---|---|---|---|
| | 9 | 10 | 11 | 12 | 1 | 2 | 3 | 4 |
| NBKP blending ratio % | 60 | 60 | 40 | 40 | 100 | 0 | 40 | 40 |
| Blending ratio of high α-cellulose pulp % | 40 | 40 | 60 | 60 | 0 | 100 | CMC-NA salt 60 | Regenerated cellulose 60 |
| α-cellulose content of high α-cellulose pulp % | 97.5 | 97.5 | 97.5 | 97.5 | — | 97.5 | — | — |
| Freeness of blended pulp mlCSF | 655 | 655 | 641 | 641 | 640 | 700 | 648 | 655 |
| Additive ratio of cationic fixer % | 0 | 5 | 0 | 0.9 | 0.9 | 0.9 | 0.9 | 0.9 |
| Additive ratio of polymeric electrolyte salt % | 2 | 2 | 5 | 0 | 2 | 2 | 2 | 2 |
| Tensile strength of base paper kN/m | 1.38 | 2.26 | 1.34 | 1.26 | 4.87 | 0.04 | 4.06 | 1.76 |
| Wet tensile strength of base paper kN/m | 0.043 | 0.029 | — | — | 0.073 | 0.000 | 0.068 | 0.044 |
| Floc dispersion time sec | 13 | 25 | 14 | 11 | 39 | 2 | 264 | 6 |
| Fiber dispersion time sec | 115 | 300 | 142 | 215 | 300≤ | 14 | 300≤ | 45 |
| Paper surface pH | 6.7 | 6.7 | 6.6 | 6.9 | 6.5 | 6.8 | 6.9 | 6.8 |
| Printability | ○ | ○ | ○ | ○ | ◎ | X | ○ | X |

TABLE 2

| | Examples | | | | | |
|---|---|---|---|---|---|---|
| | 1A | 1B | 2A | 3A | 4A | 5A |
| Type of base paper | Example 1 | Example 1 | Example 2 | Example 3 | Example 4 | Example 5 |
| Additive ratio of water-soluble polymer g/m$^2$ | 5.6 | 1.0 | 5.7 | 5.6 | 3.0 | 6.1 |

TABLE 2-continued

| | | | | | | |
|---|---|---|---|---|---|---|
| Additive ratio of water-soluble polymer % | 9.3 | 1.7 | 9.5 | 9.3 | 5.2 | 10.2 |
| Tensile strength of water dispersion paper kN/m | 4.06 | 2.78 | 3.19 | 4.94 | 0.61 | 4.98 |
| Floc dispersion time of water dispersion paper sec | 2.8 | 9.0 | 2.2 | 4.2 | 4.0 | 3.3 |
| Fiber dispersion time of water dispersion paper sec | 15.2 | 63.0 | 9.8 | 38.6 | 19.3 | 18.7 |
| Paper surface pH | 6.8 | 6.4 | 6.9 | 7.0 | 6.8 | 7.0 |
| Printability | ◎ | ○ | ◎ | ◎ | ○~Δ | ◎ |

| | Examples | | | | Comparative Examples | |
|---|---|---|---|---|---|---|
| | 6A | 7B | 11A | 12A | 1A | 2A |
| Type of base paper | Example 6 | Example 7 | Example1 1 | Example 12 | Comparative Examples 1 | Comparative Examples 2 |
| Additive ratio of water-soluble polymer g/m$^2$ | 5.7 | 5.6 | 6.3 | 7.1 | 5.5 | Could not be coated. |
| Additive ratio of water-soluble polymer % | 9.5 | 9.3 | 10.5 | 11.6 | 9.2 | Could not be coated. |
| Tensile strength of water dispersion paper kN/m | 4.39 | 4.24 | 3.13 | 3.64 | 6.03 | — |
| Floc dispersion time of water dispersion paper sec | 5.7 | 3.1 | 3.8 | 3.2 | 9.2 | — |
| Fiber dispersion time of water dispersion paper sec | 56.3 | 19.4 | 7.4 | 21.3 | 82.3 | — |
| Paper surface pH | 6.8 | 6.9 | 6.5 | 7.1 | 6.7 | — |
| Printability | ◎ | ◎ | ◎ | ◎ | ◎ | — |

EXAMPLE 13

Sixty percent by weight of needle-leaved bleached kraft pulp (hereinafter referred to as "NBKP," containing α-cellulose by 85.6 percent) and 40 percent by weight of needle-leaved mercerized pulp (containing α-cellulose by 97.5 percent, water retention level 138 percent at 450 ml CSF) were blended together and then mixed and beaten to a freeness of 641 ml CSF to obtain a papermaking material, to which polyamine resin (Arkofix 159 manufactured by Ciba Specialty Chemicals) was added as cationic fixer by 0.9 percent by weight relative to the material in equivalent solid content, along with aqueous solution of carboxylmethyl cellulose sodium salt (hereinafter referred to as "CMC"; Sunrose manufactured by Nippon Paper Industries Chemical Division) as water-soluble polymeric electrolyte salt by 2.0 percent by weight in equivalent solid content. Then, this mixture was used to produce a handmade paper of 60 g/m$^2$ in weight. A water-soluble polymer constituted by a solution containing 4 percent by weight of CMC (Sunrose manufactured by Nippon Paper Industries Chemical Division, 5 mPa·s viscosity in 2 weight-percent aqueous solution at 20° C.) was coated onto this handmade paper, using the sizing press method, by 9.3 percent by weight (5.6 g/m$^2$) relative to the handmade paper, to produce a base material for water-dispersible coated paper.

A sealer layer was coated onto the obtained base material, and a coating layer was provided on top of the sealer layer. An under layer and thermo-sensitive recording layer were coated, as the coating layer, and then dried to produce a water-dispersible coated paper of Example 13.

(Coating of Sealer Layer)

A sealer layer was formed on one side of the base material. Composition-wise, the sealer layer coating solution consisted of 53 parts by weight of silica powder (Carplex Powder manufactured by DSL. Japan) and 433 parts by weight of 12% PVA aqueous solution. This sealer layer coating solution was coated using a Meyer bar to a dry weight of 7 g/m$^2$, after which the solution was dried to form a sealer layer.

(Coating of Under Layer)

In this Example, the coating solution for under layer to be coated on top of the sealer layer which is coated on one side of the base material of the water-dispersible coated paper consists of 100 parts of sintered kaolin (XCI 300 manufactured by FECC, oil absorption amount 70 ml/100 g), 0.2 part of dispersant, 80 parts of 10% PVA solution, and 50 parts of water. This under layer coating solution was coated using a Meyer bar to a dry weight of 6 g/m$^2$, after which the solution was dried to form an under layer.

(Coating of Thermo-Sensitive Recording Layer)

Next, a thermo-sensitive recording layer was formed on top of the aforementioned under layer. Composition-wise, the coating solution for thermo-sensitive recording layer consisted of 36.0 parts of color developer dispersant, 9.2 parts of dye dispersant, 12.0 parts of sensitizer dispersant, and 12.0 parts of calcium carbonate (Brilliant-15 manufactured by Shiraishi Kogyo, average particle size 0.20=50% dispersant). This thermo-sensitive recording layer coating solution was coated using a Meyer bar to a dry weight of 5 g/m$^2$, after which the solution was dried (at 50° C.) to form a thermo-sensitive recording layer. The color developer dispersant, dye dispersant and sensitizer dispersant used were prepared, respectively, as follows:

[1] Color developer dispersant: Dispersion of 18.8 parts of 10% PVA aqueous solution, 6.0 parts of 4-hydroxy-4'-isopropoxy diphenyl sulfone and 11.2 parts of water was crushed into particles of 1 μm in average particle size using a sand grinder.

[2] Dye dispersant: Dispersion of 2.0 parts of 3-di-n-butyl amino-6-methyl-7-anilinofluoran, 4.6 parts of 10% PVA aqueous solution and 2.6 parts of water was crushed into particles of 1 μm in average particle size using a sand grinder.

[3] Sensitizer dispersant: Dispersion of 4.0 parts of 4-biphenyl p-tolyl ether, 5.0 parts of 10% PVA aqueous solution and 3.0 parts of water was crushed into particles of 1 μm in average particle size using a sand grinder.

A water-dispersible coated paper (thermo-sensitive recording paper) was obtained as above.

The obtained water-dispersible coated paper was passed through a mini-super calender tester (manufactured by Yuri Roll Machine) at a line pressure of 25 kg/m and paper-passing speed of 5 m/min, with the coating layer contacting the chilled roll (room temperature), after which a smoothing process was applied until the Oken-type smoothness fell in a range of 200 to 500 seconds.

Table 3 shows the measured results of water dispersion time, yellowing level, printability and paper surface pH of this water-dispersible coated paper.

EXAMPLE 14

A water-dispersible coated paper was produced in the same manner as in Example 13, except that the additive ratio of water-soluble polymer was changed as shown in Table 3.

EXAMPLE 15

A water-dispersible coated paper was produced in the same manner as in Example 13, except that the blending amounts of NBKP and mercerized pulp were changed as shown in Table 3.

EXAMPLE 16

A water-dispersible coated paper was produced in the same manner as in Example 13, except that the blending amounts of NBKP and mercerized pulp were changed as shown in Table 3.

EXAMPLE 17

A water-dispersible coated paper was produced in the same manner as in Example 13, except that the blending amounts of NBKP and mercerized pulp and additive ratio of water-soluble polymer were changed as shown in Table 3.

EXAMPLE 18

A water-dispersible coated paper was produced in the same manner as in Example 13, except that broad-leaved dissolving pulp obtained by sulfite cooking (containing α-cellulose by 92.0 percent, water retention level 59 percent at 450 ml CSF) was blended in as purified pulp instead of mercerized pulp and the additive ratio of water-soluble polymer was changed as shown in Table 3.

EXAMPLE 19

A water-dispersible coated paper was produced in the same manner as in Example 13, except that broad-leaved dissolving pulp obtained by sulfite cooking (containing α-cellulose by 89.0 percent, water retention level 120 percent at 450 ml CSF) was blended in as purified pulp instead of mercerized pulp and the additive ratio of water-soluble polymer was changed as shown in Table 4.

EXAMPLE 20

A water-dispersible coated paper was produced in the same manner as in Example 13, except that the blending amount of water-soluble polymeric electrolyte salt added to the papermaking material was changed as shown in Table 4.

EXAMPLE 21

A water-dispersible coated paper was produced in the same manner as in Example 15, except that the blending amounts of cationic fixer and polymeric electrolyte salt and additive ratio or water-soluble polymer were changed as shown in Table 4.

EXAMPLE 22

A water-dispersible coated paper was produced in the same manner as in Example 15, except that the blending amounts of cationic fixer and polymeric electrolyte salt and additive ratio or water-soluble polymer were changed as shown in Table 4.

EXAMPLE 23

A water-dispersible coated paper was produced in the same manner as in Example 13, except that the thermo-sensitive recording layer was changed to the inkjet recording layer as shown in Table 4.

EXAMPLE 24

A water-dispersible coated paper was produced in the same manner as in Example 13, except that the thermo-sensitive recording layer was changed to the coating layer for general printing as shown in Table 4.

EXAMPLE 25

A water-dispersible coated paper was produced in the same manner as in Example 13, except that a sealer layer was coated onto the opposite side of the base material (non-thermo-sensitive recording layer) with no under layer provided on the base material and no sealer layer provided on the thermo-sensitive recording layer side.

Comparative Example 5

A water-dispersible coated paper was produced in the same manner as in Example 13, except that only NBKP (containing α-cellulose by 85.6 percent) was used without blending any purified pulp into the papermaking material and the additive ratio of water-soluble polymer was changed as shown in Table 4.

Comparative Example 6

An attempt was made to produce a water-dispersible coated paper in the same manner as in Example 13, except that only needle-leaved mercerized pulp (containing α-cellulose by 97.5 percent, water retention level 138 percent at 450 ml CSF) was used without blending any papermaking fibers into the papermaking material, but base material for water-dispersible coated paper could not be obtained as the base material tore when the water-soluble polymer was coated.

Comparative Example 7

A water-dispersible coated paper was produced in the same manner as in Example 13, except that 40 percent by weight of NBKP and 60 percent by weight of fiber carboxylmethyl cellulose Na salt pulp (substitution degree 0.28) were blended together and then mixed and beaten to a freeness of 648 ml CSF, and the obtained papermaking material was used. The sheet had a neutral paper surface pH of 6.9, but its floc water dispersion time was 300 seconds or more, which was too long to call the paper "water dispersion paper."

Comparative Example 8

A water-dispersible coated paper was produced in the same manner as in Example 13, except that regenerated cellulose fibers (3.3 dtex×5 mm) were blended in instead of mercerized pulp. The paper surface pH was neutral at 6.8 and water dispersion property was good, but the thermo-sensitive printability (text-specific) test found that printed areas were faded due to insufficient smoothness and the paper was not suitable for thermo-sensitive printing applications.

Comparative Example 9

A handmade paper of 55 g/m$^2$ in weight was produced by using a papermaking material prepared by blending together 65 percent by weight of NBKP with a freeness of 600 ml CSF and 35 percent by weight of fiber carboxylmethyl cellulose pulp (substitution degree 0.43). This handmade paper contained water-insoluble fiber carboxylmethyl cellulose and therefore did not have water dispersion property.

A sealer layer, under layer and thermo-sensitive recording layer were coated onto one side of the obtained handmade paper and then dried in the same manner as in Example 13, after which aqueous sodium carbonate solution of 18 percent by weight in concentration was coated, as alkalization agent, onto the handmade paper from the non-sensitive recording layer side to a dry weight of 5.0 gm$^2$. Then, water-dispersible coated paper was produced by turning the water-insoluble handmade paper into the one soluble in water. The obtained water-dispersible coated paper was passed through a mini-super calender tester (manufactured by Yuri Roll Machine) at a line pressure of 25 kg/m and paper-passing speed of 5 m/min, with the coating layer contacting the chilled roll (room temperature), after which a smoothing process was applied until the Oken-type smoothness fell in a range of 100 to 200 seconds.

Since sodium carbonate of approx. twice the neutralization equivalent of acid-type fiber carboxylmethyl cellulose was coated, the sheet had an alkaline paper surface pH of 10.5 and its floc water dispersion time was 27 seconds, indicating appropriate water dispersion property, but the paper turned yellow significantly over time and was not suitable for thermo-sensitive printing applications.

TABLE 3

| | Examples | | | | | | | | |
|---|---|---|---|---|---|---|---|---|---|
| | 13 | 14 | 15 | 16 | 17 | 18 | 19 | 20 | 21 |
| NBKP blending ratio % | 60 | 60 | 40 | 80 | 10 | 60 | 60 | 60 | 40 |
| Blending ratio of high α-cellulose pulp % | 40 | 40 | 60 | 20 | 90 | 40 | 40 | 40 | 60 |
| α-cellulose content % | 97.5 | 97.5 | 97.5 | 97.5 | 97.5 | 92.0 | 89.0 | 97.5 | 97.5 |
| Freeness mlCSF | 641 | 641 | 641 | 635 | 645 | 633 | 636 | 641 | 641 |
| Additive ratio of cationic fixer % | 0.9 | 0.9 | 0.9 | 0.9 | 0.9 | 0.9 | 0.9 | 0.9 | 0 |
| Additive ratio of polymeric electrolyte salt % | 2.0 | 2.0 | 2 | 2 | 2 | 2 | 2 | 6 | 5 |
| Additive ratio of water-soluble polymer g/m$^2$ | 5.6 | 1.0 | 5.7 | 5.6 | 3.0 | 6.1 | 5.7 | 5.6 | 6.3 |
| Additive ratio of water-soluble polymer % | 9.3 | 1.7 | 9.5 | 9.3 | 5.2 | 10.2 | 9.5 | 9.3 | 10.5 |
| Attached amount of alkalization agent g/m$^2$ | 0 | 0 | 0 | 0 | 0 | 0 | 0 | 0 | 0 |
| Coating layer | Thermo-sensitive | Thermo-sensitive | Thermo-sensitive | Thermo-sensitive | Thermo-sensitive | Thermo-sensitive | Thermo-sensitive | Thermo-sensitive | Thermo-sensitive |
| Sealer layer | One side | One side | One side | One side | One side | One side | One side | One side | One side |
| Floc dispersion time | 15.7 | 29.6 | 13.2 | 23.0 | 23.2 | 20.1 | 27.3 | 18.2 | 14.8 |
| Fiber dispersion time | 59.3 | 79.0 | 40.3 | 57.5 | 48.2 | 44.9 | 70.3 | 46.6 | 33.3 |
| Yellowing level | ○ | ○ | ○ | ○ | ○ | ○ | ○ | ○ | ○ |
| Paper surface pH | 7.1 | 6.8 | 7.0 | 7.0 | 6.9 | 7.1 | 6.9 | 6.9 | 6.8 |
| Suitability for thermo-sensitive printing | ○ | ○ | ○ | ○ | ○ | ○ | ○ | ○ | ○ |
| Suitability for inkjet printing | — | — | — | — | — | — | — | — | — |
| General printability | — | — | — | — | — | — | — | — | — |
| Pressure-sensitive adhesion strength | ○ | ○ | ○ | ○ | ○ | ○ | ○ | ○ | ○ |

TABLE 4

| | Examples | | | | Comparative Examples | | | | |
|---|---|---|---|---|---|---|---|---|---|
| | 22 | 23 | 24 | 25 | 5 | 6 | 7 | 8 | 9 |
| NBKP blending ratio % | 40 | 60 | 60 | 60 | 100 | 0 | 40 | 40 | 65 |
| Blending ratio of high α-cellulose pulp % | 60 | 40 | 40 | 40 | 0 | 100 | CMC-NA salt 60 | Regenerated cellulose 60 | Acid-type CMC 35 |
| α-cellulose content of high a-cellulose pulp % | 97.5 | 97.5 | 97.5 | 97.5 | — | 97.5 | — | — | — |
| Freeness of blended pulp mlCSF | 641 | 641 | 641 | 641 | 640 | 700 | 648 | 655 | 600 |
| Additive ratio of cationic fixer % | 0.9 | 0.9 | 0.9 | 0.9 | 0.9 | 0.9 | 0.9 | 0.9 | 0 |
| Additive ratio of polymeric electrolyte salt % | 0 | 2.0 | 2.0 | 2.0 | 2 | 2 | 2.0 | 2.0 | 0 |
| Additive ratio of water-soluble polymer g/m$^2$ | 7.1 | 5.6 | 5.6 | 5.6 | 5.5 | Could not be coated. | 5.6 | 5.6 | 0 |
| Additive ratio of water-soluble polymer % | 11.6 | 9.3 | 9.3 | 9.3 | 9.2 | Could not be coated. | 9.3 | 9.3 | 0 |
| Attached amount of alkalization agent g/m$^2$ | 0 | 0 | 0 | 0 | 0 | 0 | 0 | 0 | 5.0 |
| Coating layer | Thermo-sensitive | IJ | General | Thermo-sensitive | Thermo-sensitive | — | Thermo-sensitive | Thermo-sensitive | Thermo-sensitive |
| Sealer layer | One side | One side | One side | One side | One side | — | One side | One side | One side |
| Floc dispersion time | 19.5 | 11.2 | 10.1 | 16.1 | 42.9 | — | 249 | 17.4 | 27.0 |

TABLE 4-continued

| | Examples | | | | Comparative Examples | | | | |
|---|---|---|---|---|---|---|---|---|---|
| | 22 | 23 | 24 | 25 | 5 | 6 | 7 | 8 | 9 |
| Fiber dispersion time | 55.4 | 36.5 | 33.4 | 60.3 | 300< | — | 300< | 22.9 | 79.8 |
| Yellowing level | ○ | ○ | ○ | ○ | ○ | — | ○ | ○ | X |
| Paper surface pH | 7.0 | 6.9 | 6.9 | 7.0 | 7.1 | — | 6.9 | 6.8 | 10.5 |
| Suitability for thermo-sensitive printing | ○ | — | — | ○ | ○ | — | ○ | X | ○ |
| Suitability for inkjet printing | — | ○ | — | — | — | — | — | — | — |
| General printability | — | — | ○ | — | — | — | — | — | — |
| Pressure-sensitive adhesion strength | ○ | ○ | ○ | ○ | ○ | — | ○ | ○ | ○ |

We claim:

1. A water dispersion paper made of wood pulp and/or non-wood pulp, wherein said water dispersion paper is characterized in that purified pulp containing α-cellulose by 88 percent by weight or more accounts for 15 to 95 percent by weight of all pulp, and the water dispersion paper contains a water-soluble polymeric electrolyte salt.

2. A water dispersion paper made of wood pulp and/or non-wood pulp, wherein purified pulp containing hemi-cellulose by less than 12 percent by weight accounts for 15 to 95 percent by weight of all pulp, and the water dispersion paper contains a water-soluble polymeric electrolyte salt.

3. A water dispersion paper according to claim 2, characterized in that it does not contain regenerated cellulose fibers, fiber carboxylmethyl cellulose, or fiber carboxylmethyl cellulose Na salt.

4. A water dispersion paper according to claim 2, characterized in that its paper surface pH is 6 to 8.

5. A water dispersion paper according to claim 2, characterized in that its floc water dispersion time, defined as the time until a test piece of 3×3 cm square, put in a beaker containing water, tears into two or more pieces when agitated with a stirrer at 650 rpm, is within 30 seconds.

6. A water dispersion paper according to claim 2, wherein the water-soluble polymeric electrolyte salt is at least one selected from the group consisting of carboxymethyl cellulose salt, alginate, carboxymethylated starch, polyacrylate, polymethacrylate, anionic polyacrylamide, and amphoteric polyacrylamide.

7. A water dispersion paper according to claim 2, further containing a cationic fixer.

8. A water dispersion paper according to claim 7, wherein the cationic fixer is a polyamine resin expressed by General Formula (1) below:

(1)

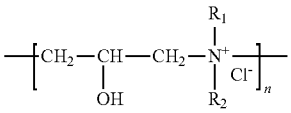

wherein $R_1$ represents an alkyl group with 1 to 10 carbons that may include a hydroxyl group, hydroxymethyl group, hydroxyethyl group, or other substitution group, wherein the above substitution groups are not counted toward the carbon number; $R_2$ represents a hydrogen atom or alkyl group with 1 to 10 carbons that may contain a hydroxyl group, hydroxymethyl group, hydroxyethyl group, or other substitution group, wherein the above substitution groups are not counted toward the carbon number; and n represents a positive integer.

9. A water dispersion paper according to claim 1, characterized in that it does not contain regenerated cellulose fibers, fiber carboxylmethyl cellulose or fiber carboxylmethyl cellulose Na salt.

10. A water dispersion paper according to claim 1, characterized in that its paper surface pH is 6 to 8.

11. A water dispersion paper according to claim 1, characterized in that its floc water dispersion time, defined as the time until a test piece of 3×3 cm square, put in a beaker containing water, tears into two or more pieces when agitated with a stirrer at 650 rpm, is within 30 seconds.

12. A water dispersion paper according to claim 1, wherein the water-soluble polymeric electrolyte salt is at least one selected from the group consisting of carboxymethyl cellulose salt, alginate, carboxymethylated starch, polyacrylate, polymethacrylate, anionic polyacrylamide, and amphoteric polyacrylamide.

13. A water dispersion paper according to claim 1, further containing a cationic fixer.

14. A water dispersion paper according to claim 13, wherein the cationic fixer is a polyamine resin expressed by General Formula (1) below:

(1)

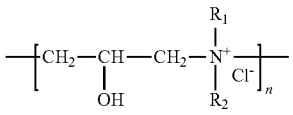

wherein $R_1$ represents an alkyl group with 1 to 10 carbons that may include a hydroxyl group, hydroxymethyl group, hydroxyethyl group, or other substitution group, wherein the above substitution groups are not counted toward the carbon number; $R_2$ represents a hydrogen atom or alkyl group with 1 to 10 carbons that may contain a hydroxyl group, hydroxymethyl group, hydroxyethyl group, or other substitution group, wherein the above substitution groups are not counted toward the carbon number; and n represents a positive integer.

* * * * *